US009341963B2

(12) United States Patent
Hirakata et al.

(10) Patent No.: US 9,341,963 B2
(45) Date of Patent: May 17, 2016

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Masaki Hirakata, Kanagawa (JP); Hideya Katsuhara, Kanagawa (JP); Takeshi Iwanaga, Kanagawa (JP); Nobuyuki Torigoe, Kanagawa (JP); Takashi Imai, Kanagawa (JP); Tomoya Sasaki, Kanagawa (JP); Shigeto Hashiba, Kanagawa (JP); Kenta Ide, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/016,641

(22) Filed: Sep. 3, 2013

(65) Prior Publication Data

US 2014/0295334 A1 Oct. 2, 2014

(30) Foreign Application Priority Data

Mar. 27, 2013 (JP) ..... 2013-066296

(51) Int. Cl.

| | |
|---|---|
| ***G03G 5/047*** | (2006.01) |
| ***G03G 5/043*** | (2006.01) |
| ***G03G 5/05*** | (2006.01) |
| ***G03G 5/147*** | (2006.01) |

(52) U.S. Cl.

CPC ..... *G03G 5/047* (2013.01); *G03G 5/0436* (2013.01); *G03G 5/0507* (2013.01); *G03G 5/14704* (2013.01)

(58) Field of Classification Search

CPC .... G03G 5/047; G03G 5/0436; G03G 5/0507
USPC ..... 430/58.1, 66, 67; 399/159, 111
See application file for complete search history.

(56) References Cited

U.S. PATENT DOCUMENTS

| | | | | |
|---|---|---|---|---|
| 4,848,141 | A | 7/1989 | Oliver et al. | |
| 5,096,795 | A * | 3/1992 | Yu | 430/58.8 |
| 6,326,111 | B1 * | 12/2001 | Chambers et al. | 430/58.05 |
| 7,081,234 | B1 * | 7/2006 | Qi et al. | 430/58.1 |
| 7,232,633 | B2 * | 6/2007 | Qi et al. | 430/58.8 |
| 7,267,916 | B2 * | 9/2007 | Sugino et al. | 430/66 |

(Continued)

FOREIGN PATENT DOCUMENTS

| | | |
|---|---|---|
| JP | A-2-110470 | 4/1990 |
| JP | A-11-186571 | 7/1999 |

(Continued)

OTHER PUBLICATIONS

English language machine translation of JP 2002-287387 (Oct. 2002).*

(Continued)

*Primary Examiner* — Christopher Rodee
(74) *Attorney, Agent, or Firm* — Oliff PLC

(57) ABSTRACT

An electrophotographic photoreceptor includes a conductive substrate; an organic photosensitive layer that is provided on the conductive substrate; and an inorganic protective layer that is provided on the organic photosensitive layer so as to be in contact with a surface of the organic photosensitive layer, wherein the organic photosensitive layer includes at least a charge transport material and silica particles in a region on the surface side in contact with the inorganic protective layer.

12 Claims, 6 Drawing Sheets

(56) References Cited

U.S. PATENT DOCUMENTS

| | | | | |
|---|---|---|---|---|
| 8,043,773 | B2 * | 10/2011 | Ikuno et al. | 430/58.7 |
| 8,492,059 | B2 * | 7/2013 | Hashiba et al. | 430/67 |
| 2005/0233231 | A1 * | 10/2005 | Qi et al. | 430/58.65 |
| 2008/0254379 | A1 | 10/2008 | Iwanaga et al. | |
| 2008/0305415 | A1 * | 12/2008 | Wu et al. | 430/58.1 |
| 2008/0305416 | A1 * | 12/2008 | Wu et al. | 430/58.1 |

FOREIGN PATENT DOCUMENTS

| | | | | |
|---|---|---|---|---|
| JP | 2002287387 A | * | 10/2002 | G03G 5/047 |
| JP | A-2003-27238 | | 1/2003 | |
| JP | A-2003-98700 | | 4/2003 | |
| JP | A-2006-10921 | | 1/2006 | |
| JP | A-2006-267507 | | 10/2006 | |
| JP | 2007-057804 A | | 3/2007 | |
| JP | A-2008-268266 | | 11/2008 | |
| JP | A-2009-204922 | | 9/2009 | |

OTHER PUBLICATIONS

Jul. 7, 2015 Office Action issued in Japanese Application No. 2013-066296.

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2013-066296 filed Mar. 27, 2013.

BACKGROUND

1. Technical Field

The present invention relates to an electrophotographic photoreceptor, a process cartridge, and an image forming apparatus.

2. Related Art

Electrophotography is widely used for copying machines, printers, or the like.

Recently, techniques have been discussed which relate to an electrophotographic photoreceptor (hereinafter, also referred to as a "photoreceptor") used for an electrophotographic image forming apparatus and in which a surface layer (protective layer) is formed on a photosensitive layer surface of the photoreceptor.

SUMMARY

According to an aspect of the invention, there is provided an electrophotographic photoreceptor including: a conductive substrate; an organic photosensitive layer that is provided on the conductive substrate; and an inorganic protective layer that is provided on the organic photosensitive layer so as to be in contact with a surface of the organic photosensitive layer, wherein the organic photosensitive layer includes at least a charge transport material and silica particles in a region on the surface side in contact with the inorganic protective layer.

BRIEF DESCRIPTION OF THE DRAWINGS

Exemplary embodiments of the present invention will be described in detail based on the following figures, wherein.

DETAILED DESCRIPTION

Figure 1:
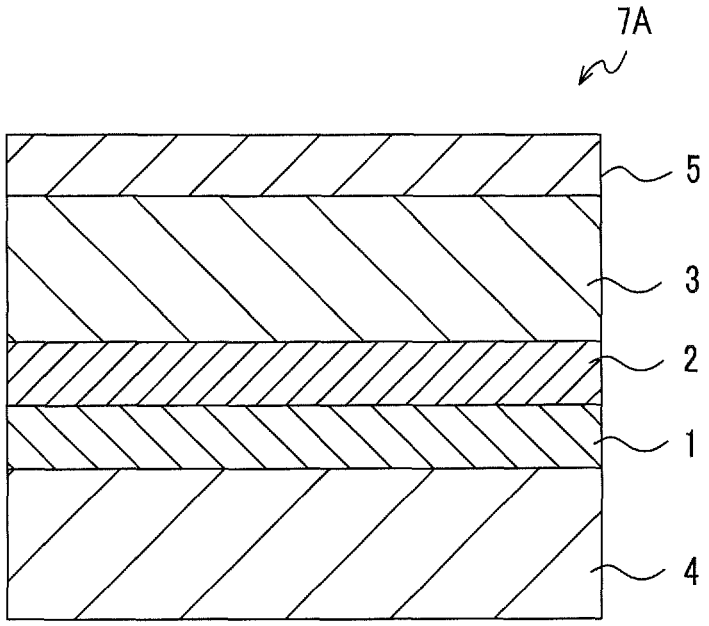
FIG. 1 is a cross-sectional view schematically illustrating a layer configuration example of an electrophotographic photoreceptor according to an exemplary embodiment of the present invention.

Hereinafter, exemplary embodiments of the present invention will be described in detail.

Electrophotographic Photoreceptor

An electrophotographic photoreceptor according to an exemplary embodiment of the invention includes a conductive substrate; an organic photosensitive layer that is provided on the conductive substrate; and an inorganic protective layer that is provided on the organic photosensitive layer so as to be in contact with a surface of the organic photosensitive layer.

The organic photosensitive layer includes at least a charge transport material and silica particles in a region on the surface side in contact with the inorganic protective layer.

Specifically, when the organic photosensitive layer is configured as a single layer, the organic photosensitive layer at least includes a charge generation layer, a charge transport material, and silica particles.

On the other hand, when the organic photosensitive layer is configured as a function separation type organic photosensitive layer, the organic photosensitive layer includes a charge generation layer and a charge transport layer, which includes at least a charge transport material and silica particles, on the conductive substrate in this order. In this case, when the charge transport layer includes two or more layers, a the charge transport layer of layer (uppermost layer), which forms a surface in contact with the inorganic protective layer, includes at least a charge transport material and silica particles; and a layer of the charge transport layer, which is positioned below the layer forming the surface in contact with the inorganic protective layer, does not include silica particles and includes at least a charge transport material.

In the related art, techniques of forming an inorganic protective layer on an organic photosensitive layer so as to be in contact with a surface thereof, are known.

However, the organic photosensitive layer is flexible and is likely to be deformed, whereas the inorganic protective layer is hard and is likely to have low toughness. Therefore, when the organic photosensitive layer, which is an undercoat layer of the inorganic protective layer, is deformed, the inorganic protective layer may be cracked. Since a mechanical load is likely to be applied to the electrophotographic photoreceptor from a member (for example, an intermediate transport member) positioned in contact with a surface of the electrophotographic photoreceptor, it is considered that such a phenomenon is likely to occur.

Therefore, the organic photosensitive layer according to the exemplary embodiment includes at least a charge transport material and silica particles in a region on the surface side in contact with the inorganic protective layer. As a result, it is considered that the silica particles function as a reinforcing material of the organic photosensitive layer; and the organic photosensitive layer is not likely to be deformed at least in the region positioned on the surface side in contact with the inorganic protective layer, which is an undercoat layer of the inorganic protective layer. Therefore, it is considered that the cracking of the inorganic protective layer is suppressed.

Meanwhile, it is considered that, when inorganic particles such as a reinforcing member are present in the organic photosensitive layer, the inorganic particles form charge accumulation sites (trap sites) where a residual potential is generated; and as a result, a residual potential is likely to be generated.

However, it is considered that silica particles have a lower dielectric constant than that of the other inorganic particles and thus are not likely to form charge accumulation sites (trap sites) where a residual potential is generated. Therefore, it is considered that the generation of a residual potential is also suppressed.

As described above, in the electrophotographic photoreceptor according to the exemplary embodiment, the cracking of the inorganic protective layer and the generation of a residual potential are suppressed due to the above-described configurations.

In addition, the electrophotographic photoreceptor according to the exemplary embodiment has also an effect in that the transparency of the organic photosensitive layer is easily secured because silica particles have a lower dielectric constant than that of the other inorganic particles; and deterioration in electrical characteristics, which is caused by deterioration in the transparency of the organic photosensitive layer due to incorporated silica particles, is also suppressed.

Hereinafter, the electrophotographic photoreceptor according to the exemplary embodiment will be described in detail with reference to the drawings. In the drawings, the same or corresponding components are represented by the same reference numeral, and the description thereof will not be repeated.

Figure 2:
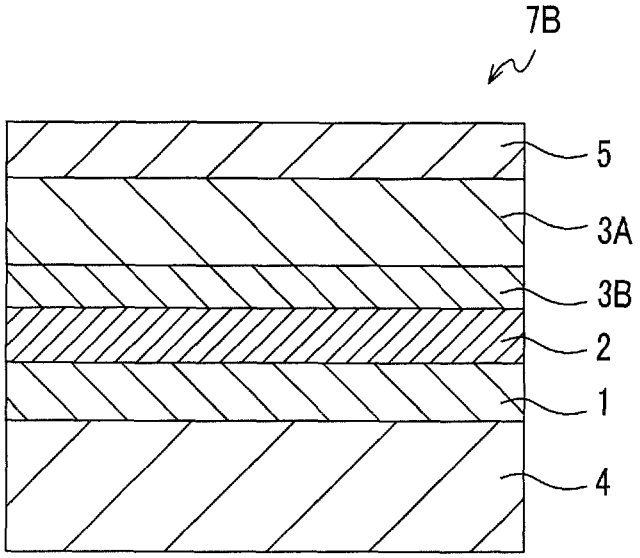
FIG. 2 is a cross-sectional view schematically illustrating another layer configuration example of the electrophotographic photoreceptor according to the exemplary embodiment.
Figure 3:
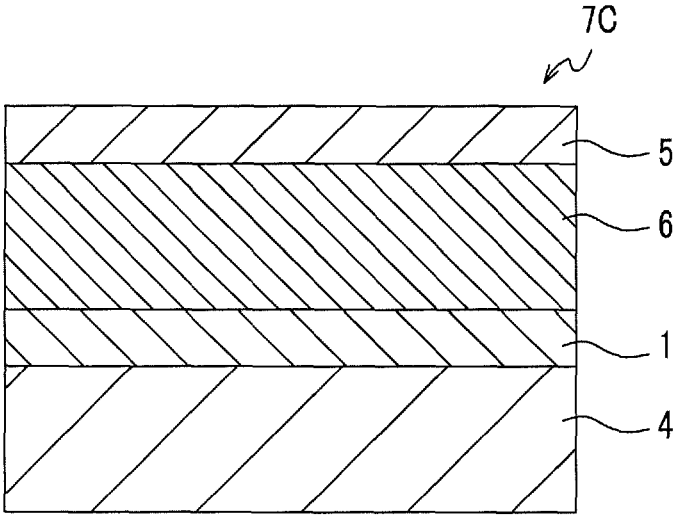
FIG. 3 is a cross-sectional view schematically illustrating another layer configuration example of the electrophotographic photoreceptor according to the exemplary embodiment.

FIG. 1 is a cross-sectional view schematically illustrating an example of the electrophotographic photoreceptor according to the exemplary embodiment. FIGS. 2 and 3 are respectively cross-sectional views schematically illustrating other examples of the electrophotographic photoreceptor according to the exemplary embodiment.

An electrophotographic photoreceptor 7A illustrated in FIG. 1 is a so-called function separation type photoreceptor (or multilayer type photoreceptor) and has a structure in which an undercoat layer 1 is provided on a conductive substrate 4; and a charge generation layer 2, a charge transport layer 3, and an inorganic protective layer 5 are formed thereon in this order. In the electrophotographic photoreceptor 7A, the charge generation layer 2 and the charge transport layer 3 form an organic photosensitive layer.

The charge transport layer 3 includes at least a charge transport material and silica particles.

Similarly to the case of the electrophotographic photoreceptor 7A illustrated in FIG. 1, an electrophotographic photoreceptor 7B illustrated in FIG. 2 is a function separation type photoreceptor in which functions of the charge generation layer 2 and the charge transport layer 3 are separated; and furthermore, functions of the charge transport layer 3 are separated. In addition, in an electrophotographic photoreceptor 7C illustrated in FIG. 3, a single layer (single-layer type organic photosensitive layer 6 (charge generation and charge transport layer)) contains a charge generation material and a charge transport material.

The electrophotographic photoreceptor 7B illustrated in FIG. 2 has a structure in which the undercoat layer 1 is formed on the conductive substrate 4; and the charge generation layer 2, a charge transport layer 3B, a charge transport layer 3A, and the inorganic protective layer 5 are formed thereon in this order. In the electrophotographic photoreceptor 7B, the charge transport layer 3A, the charge transport layer 3B, and the charge generation layer 2 form an organic photosensitive layer.

The charge transport layer 3A includes at least a charge transport material and silica particles. On the other hand, the charge transport layer 3B does not include silica particles and includes at least a charge transport material.

The electrophotographic photoreceptor 7C illustrated in FIG. 3 has a structure in which the undercoat layer 1 is formed on the conductive substrate 4; and the single-layer type photosensitive layer 6 and the inorganic protective layer 5 are formed thereon in this order.

The single-layer type photosensitive layer 6 includes at least a charge generation material, a charge transport material, and silica particles.

In the electrophotographic photoreceptors illustrated in FIGS. 1 to 3, the undercoat layer 1 is not necessarily provided.

Hereinbelow, each component of the electrophotographic photoreceptor 7A illustrated in FIG. 1 will be described as a representative example.

Conductive Substrate

Any conductive substrates may be used as long as they are used in the related art. Examples thereof include plastic films in which a thin film (for example, a film of metals such as aluminum, nickel, chromium, and stainless steel and a film of aluminum, titanium, nickel, chromium, stainless steel, gold, vanadium, tin oxide, indium oxide, indium tin oxide (ITO), and the like) is provided; papers to which a conductivity imparting agent is applied or impregnated; and plastic films to which a conductivity imparting agent is applied or impregnated. The shape of the substrate is not limited to a cylindrical shape and may be a sheet shape and a plate shape.

For example, as the conductive substrate, a conductive substrate having a volume resistivity of less than $10^7$ Ω·cm is preferable.

When a metal pipe is used as the conductive substrate, the surface need not to be subjected to any processes, or may be subjected to a process such as mirror-surface cutting, etching, anodic oxidation, rough cutting, centerless grinding, sand blasting, or wet honing in advance.

Undercoat Layer

The undercoat layer is optionally provided for the purposes of, for example, preventing light reflection on a surface of the conductive substrate and preventing the incorporation of unnecessary carriers from the conductive substrate into the organic photosensitive layer.

For example, the undercoat layer includes a binder resin and, optionally, other additives.

Examples of the binder resin included in the undercoat layer include well-known polymer resin compounds such as acetal resins (for example, polyvinyl butyral), polyvinyl alcohol resins, caseins, polyamide resins, cellulosic resins, gelatins, polyurethane resins, polyester resins, methacrylic resins, acrylic resins, polyvinylchloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resins; and charge transport resins having a charge transport group and conductive resins such as polyanilines. Among these, resins which are insoluble in a coating solvent of an upper layer are preferably used. In particular, for example, phenol resins, phenol-formaldehyde resins, melamine resins, urethane resins, and epoxy resins are preferably used.

The undercoat layer may contain a metal compound such as a silicone compound, an organic zirconium compound, an organic titanium compound, or an organic aluminum compound.

The mixing ratio of the metal compound and the binder resin is not particularly limited and is set in a range where desired electrophotographic photoreceptor characteristics are obtained.

In order to adjust the surface roughness, resin particles may be added to the undercoat layer. Examples of the resin particles include silicone resin particles and cross-linked polymethylmethacrylate (PMMA) resin particles. In order to adjust the surface roughness, a surface of the undercoat layer may be polished after being formed. Examples of the polishing method include buffing, sand blasting, wet honing, and grinding.

The undercoat layer includes, for example, at least a binder resin and conductive particles. It is preferable that the conductive particles be conductive to have, for example, a volume resistivity of less than $10^7$ Ω·cm.

Examples of the conductive particles include metal particles (for example, particles of aluminum, copper, nickel, silver, or the like), conductive metal oxide particles (for example, particles of antimony oxide, indium oxide, tin oxide, zinc oxide, or the like), and particles of conductive materials (particles of carbon fiber, carbon black, or graphite powders). Among these, conductive metal oxide particles are preferable. As the conductive particles, the above examples may be used as a mixture of two or more kinds.

In addition, surfaces of the conductive particles may be treated with a hydrophobizing agent (for example, a coupling agent) and the resistance thereof may be adjusted before use.

The content of the conductive particles is, for example, preferably from 10% by weight to 80% by weight and more preferably from 40% by weight to 80% by weight with respect to the binder resin.

A method of forming the undercoat layer is not particularly limited, and well-known formation methods are used. For example, the undercoat layer may be formed by forming a coating film of an undercoat layer-forming coating solution in which the above-described components are added to a solvent; drying the coating film; and optionally heating the coating film.

Examples of a method of coating the undercoat layer-forming coating solution on the conductive substrate include a dip coating method, a push-up coating method, a wire-bar coating method, a spray coating method, a blade coating method, a knife coating method, and a curtain coating method.

When particles are dispersed in the undercoat layer-forming coating solution, examples of a dispersing method thereof include methods using medium dispersers such as a ball mill, a vibration ball mill, an attritor, a sand mill, and a horizontal sand mill; and mediumless dispersers such as a stirrer, an ultrasonic disperser, a roll mill, or a high-pressure homogenizer. Examples of the high-pressure homogenizer include a collision type dispersing a dispersion in a high-pressure state through liquid-liquid collision or liquid-wall collision; and a pass-through type dispersing a dispersion by causing it to pass through a fine flow path in a high-pressure state.

The thickness of the undercoat layer is preferably greater than or equal to 15 μm and more preferably from 20 μm to 50 μm.

Although not illustrated in the drawing, an intermediate layer may be provided between the undercoat layer and the photosensitive layer. Examples of a binder resin used for the intermediate layer include polymer resin compounds such as acetal resins such as polyvinyl butyral, polyvinyl alcohol resins, caseins, polyamide resins, cellulosic resins, gelatins, polyurethane resins, polyester resins, methacrylic resins, acrylic resins, polyvinylchloride resins, polyvinyl acetate resins, vinyl chloride-vinyl acetate-maleic anhydride resins, silicone resins, silicone-alkyd resins, phenol-formaldehyde resins, and melamine resins; and organic metal compounds containing zirconium, titanium, aluminum, manganese, or silicon atom. These compounds may be used alone or as a mixture or a polycondensate of plural kinds of compounds. Among these, organic metal compounds containing zirconium or silicon are preferable from the viewpoints of low residual potential, less change in potential due to an environment, and less change in potential due to repetitive use.

A method of forming the intermediate layer is not particularly limited, and well-known formation methods are used. For example, the intermediate layer may be formed by forming a coating film of an intermediate layer-forming coating solution in which the above-described components are added to a solvent; drying the coating film; and optionally heating the coating film.

Examples of a method of coating the intermediate layer-forming coating solution on the undercoat layer include well-known methods such as a dip coating method, a push-up coating method, a wire-bar coating method, a spray coating method, a blade coating method, a knife coating method, and a curtain coating method.

The intermediate layer has a function of improving a coating property of an upper layer as well as a function of an electrical blocking layer. Therefore, when the thickness thereof is too large, electrical blocking works excessively, which may lead to a decrease in sensitivity and an increase in potential due to repetitive use. Therefore, when the intermediate layer is formed, the thickness thereof is preferably set to be from 0.1 μm to 3 μm. In addition, in this case, the intermediate layer may be used as the undercoat layer.

Charge Generation Layer

The charge generation layer includes, for example, a charge generation material and a binder resin. The charge generation layer may be configured as, for example, a vapor deposition film of the charge generation material.

Examples of the charge generation material include phthalocyanine pigments such as metal-free phthalocyanines, chlorogallium phthalocyanines, hydroxygallium phthalocyanines, dichlorotin phthalocyanines, and titanyl phthalocyanines. In particular, examples thereof include chlorogallium phthalocyanine crystal having strong diffraction peaks at Bragg angles (2θ±0.2°) of at least 7.4°, 16.6°, 25.5°, and 28.3° with respect to CuKα characteristic X-rays; metal-free phthalocyanine crystal having strong diffraction peaks at Bragg angles (2θ±0.2°) of at least 7.7°, 9.3°, 16.9°, 17.5°, 22.4°, and 28.8° with respect to CuKα characteristic X-rays; hydroxygallium phthalocyanine crystal having strong diffraction peaks at Bragg angles (2θ±0.2°) of at least 7.5°, 9.9°, 12.5°, 16.3°, 18.6°, 25.1°, and 28.3° with respect to CuKα characteristic X-rays; and titanyl phthalocyanine crystals having strong diffraction peaks at Bragg angles (2θ±0.2°) of at least 9.6°, 24.1°, and 27.2° with respect to CuKα characteristic X-rays. Other examples of the charge generation material include quinone pigments, perylene pigments, indigo pigments, bisbenzimidazole pigments, anthrone pigments, and quinacridone pigments. In addition, as the charge generation material, these examples may be used alone or in a combination of two or more kinds.

Examples of the binder resin included in the charge generation layer include bisphenol A or bisphenol Z polycarbonate resins, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and poly-N-vinylcarbazole resins. As the binder resin, these examples may be used alone or in a combination of two or more kinds.

In addition, the mixing ratio of the charge generation material and the binder resin is, for example, preferably in the range of 10:1 to 1:10.

A method of forming the charge generation layer is not particularly limited, and well-known formation methods are used. For example, the intermediate layer may be formed by forming a coating film of a charge generation layer-forming coating solution in which the above-described components are added to a solvent; drying the coating film; and optionally heating the coating film. The charge generation layer may be formed by the vapor deposition of the charge generation material.

Examples of a method of coating the charge generation layer-forming coating solution on the undercoat layer (or on the intermediate layer) include a dip coating method, a push-up coating method, a wire-bar coating method, a spray coating method, a blade coating method, a knife coating method, and a curtain coating method.

Examples of a method of dispersing particles (for example, the charge generation material) in the charge generation layer-forming coating solution include methods using medium dispersers such as a ball mill, a vibration ball mill, an attritor, a sand mill, and a horizontal sand mill; and medium-less dispersers such as a stirrer, an ultrasonic disperser, a roll mill, or a high-pressure homogenizer. Examples of the high-pressure homogenizer include a collision type dispersing a dispersion in a high-pressure state through liquid-liquid collision or liquid-wall collision; and a pass-through type dispersing a dispersion by causing it to pass through a fine flow path in a high-pressure state.

The thickness of the charge generation layer is preferably from 0.01 μm to 5 μm and more preferably from 0.05 μm to 2.0 μm.

Charge Transport Layer

Composition of Charge Transport Layer

The charge transport layer includes a charge transport material, silica particles, and optionally, a binder resin.

Examples of the charge transport material include hole transport materials including oxadiazole derivatives such as 2,5-bis(p-diethylaminophenyl)-1,3,4-oxadiazole, pyrazoline derivatives such as 1,3,5-triphenyl-pyrazoline and 1-[pyridyl-(2)]-3-(p-diethylaminostyryl)-5-(p-diethylaminostyryl)pyrazoline, aromatic tertiary amino compounds such as triphenylamine, tris[4-(4,4-diphenyl-1,3-butadienyl)phenyl]amine, N,N'-bis(3,4-dimethylphenyl)biphenyl-4-amine, tri(p-methylphenyl)aminyl-4-amine, and dibenzylaniline, aromatic tertiary diamino compounds such as N,N'-bis(3-methylphenyl)-N,N'-diphenylbenzidine, 1,2,4-triazine derivatives such as 3-(4'-dimethylaminophenyl)-5,6-di-(4'-methoxyphenyl)-1,2,4-triazine, hydrazone derivatives such as 4-dimethylaminobenzaldehyde-1,1-diphenylhydrazone, quinazoline derivatives such as 2-phenyl-4-styryl-quinazoline, benzofuran derivatives such as 6-hydroxy-2,3-di(p-methoxyphenyl)benzofuran, α-stilbene derivatives such as p-(2,2-diphenylvinyl)-N,N-diphenylaniline, enamine derivatives, carbazole derivatives such as N-ethylcarbazole, poly-N-vinylcarbazole and derivatives thereof; electron transport materials including quinone compounds such as chloranil and bromoanthraquinone, tetracyanoquinodimethane compounds, fluorenone compounds such as 2,4,7-trinitrofluorenone and 2,4,5,7-tetranitro-9-fluorenone, xanthone compounds, and thiophene compounds; and polymers having a group composed of the above-described compounds at the main chain or a side chain thereof. As the charge transport material, these examples may be used alone or in a combination of two or more kinds.

The content of the charge transport material is preferably greater than or equal to 40% by weight, more preferably from 40% by weight to 70% by weight, and still more preferably from 40% by weight to 60% by weight with respect to a weight obtained by subtracting the weight of the silica particles from the weight of all the components of the charge transport layer.

In addition, it is preferable that the content of the charge transport material be less than that of the silica particles.

When the content of the charge transport material is in the above-described range, the generation of a residual potential is easily suppressed.

Examples of the silica particles include dry silica particles and wet silica particles.

Examples of the dry silica particles include combustion method silica (fumed silica) obtained by combusting a silane compound; and deflagration method silica obtained by explosively combusting metal silicon powder.

Examples of the wet silica particles include wet silica particles obtained by neutralization of sodium silicate and a mineral acid (for example, precipitation method silica which is synthesized and aggregated under alkali conditions and gel method silica particles which are synthesized and aggregated under acid conditions); colloidal silica particles (silica sol particles) obtained by making acidic silicic acid alkaline and performing polymerization; and sol-gel method silica particles obtained by hydrolysis of an organic silane compound (for example, alkoxysilane).

Among these, as the silica particles, combustion method silica particles which have a small number of silanol groups on the surfaces thereof and a low void structure are preferable from the viewpoints of suppressing the generation of a residual potential and suppressing image defects (suppressing deterioration in thin line reproducibility) caused by deterioration in electrical characteristics.

The volume average particle diameter of the silica particles is, for example, preferably from 20 nm to 200 nm, more preferably from 30 nm to 200 nm, and still more preferably from 40 nm to 150 nm.

When the volume average particle diameter is in the above-described range, the cracking of the inorganic protective layer and the generation of a residual potential are easily suppressed.

The volume average particle diameter is obtained as follows. Silica particles are separated from the layer; 100 primary particles of the silica particles are observed using a scanning electron microscope (SEM) at a magnification of 40,000 times; the maximum diameter and the minimum diameter of each particle are measured by the image analysis of the primary particles; and a spherical equivalent diameter is measured from the intermediate value. A 50% diameter (D50v) in the cumulative frequency of the obtained spherical equivalent diameter is obtained as the volume average particle diameter of the silica particles.

It is preferable that surfaces of the silica particles be treated with a hydrophobizing agent. Accordingly, the number of silanol groups on the surfaces of the silica particles is reduced and the generation of a residual potential is easily suppressed.

Examples of the hydrophobizing agent include well-known silane compounds such as chlorosilane, alkoxysilane, and silazane.

Among these, as the hydrophobizing agent, a silane compound having a trimethylsilyl group, a decylsilyl group, or a phenylsilyl group is preferable from the viewpoint of suppressing the generation of a residual potential. That is, it is preferable that a trimethylsilyl group, a decylsilyl group, or a phenylsilyl group be included in the surfaces of the silica particles.

Examples of the silane compound having a trimethylsilyl group include trimethylchlorosilane, trimethylmethoxysilane, and 1,1,1,3,3,3-hexamethyldisilazane.

Examples of the silane compound having a decylsilyl group include decyltrichlorosilane, decyldimethylchlorosilane, and decyltrimethoxysilane.

Examples of the silane compound having a phenyl group include triphenylmethoxysilane and triphenylchlorosilane.

A condensation ratio of the silica particles of which the surfaces are treated with the hydrophobizing agent (ratio of Si—O—Si to $SiO_4$— bonds in the silica particles; hereinbelow, referred to as "condensation ratio of hydrophobizing agent") is preferably higher than or equal to 90%, more preferably higher than or equal to 91%, and still more preferably higher than or equal to 95% with respect to the silanol groups on the surfaces of the silica particles.

When the condensation ratio of the hydrophobizing agent is in the above-described range, the silanol groups of the silica particles are reduced; and the generation of a residual potential is easily suppressed.

The condensation ratio of the hydrophobizing agent indicates the ratio of condensed silicon to all the condensation sites to which silicon may be bonded which are detected by NMR; and is measured as follows.

First, silica particles are separated from the layer. Si CP/MAS NMR analysis is performed on the separated silica particles using AVANCE III 400 (manufactured by Bruker Corporation) to obtain a peak area corresponding to the substitution number of SiO. Values of 2-substituted ($Si(OH)_2(0\text{-}Si)_2$—), 3-substituted ($Si(OH)(0\text{-}Si)_3$—), and 4-substituted ($Si(0\text{-}Si)_4$—) are set to Q2, Q3, and Q4, respectively. The condensation ratio of the hydrophobizing agent is calculated from the expression of $(Q2\times2+Q3\times3+Q4\times4)/4\times(Q2+Q3+Q4)$.

The volume resistivity of the silica particles is, for example, preferably greater than or equal to $10^{11}$ Ω·cm, more preferably greater than or equal to $10^{12}$ Ω·cm, and still more preferably greater than or equal to $10^{13}$ Ω·cm.

When the volume resistivity of the silica particles is in the above-described range, deterioration in thin line reproducibility is suppressed.

The volume resistivity of the silica particles is measured as follows in a measurement environment of a temperature of 20° C. and a humidity of 50% RH.

First, silica particles are separated from the layer. Then, the separated silica particles as a measurement target are placed on a surface of a circular jig, on which a 20 $cm^2$ electrode plate is disposed, at a thickness of approximately from 1 mm to 3 mm. As a result, a silica particle layer is formed. The same 20 $cm^2$ electrode plate as above is disposed on the silica particle layer such that the silica particle layer is interposed between the electrode plates. In order to reduce voids between the silica particles, a load of 4 kg is applied to the electrode plate which is disposed on the silica particle layer. Next, the thickness (cm) of the silica particle layer is measured. An electrometer and a high-voltage power supply are connected to both of the upper and lower electrodes of the hydrophobic silica particle layer. A high voltage is applied to both of the electrodes so as to obtain a predetermined electric field. At this time, by reading a flowing current value (A), the volume resistivity (Ω·cm) of the silica particles is calculated. An expression for calculating the volume resistivity (Ω·cm) of the silica particles is as follows.

In the expression, ρ represents the volume resistivity (Ω·cm) of the hydrophobic silica particles; E represents the applied voltage (V); I represents the current value (A); $I_0$ represents the current value (A) at a applied voltage of 0 V; and L represents the thickness (cm) of the hydrophobic silica particle layer. In this evaluation, the volume resistivity is used at an applied voltage of 1000 V.

$$\rho=E\times20/(I-I_0)/L \qquad \text{Expression:}$$

The content of the silica particles is preferably from 30% by weight to 70% by weight, more preferably from 40% by weight to 70% by weight, and still more preferably from 45% by weight to 65% by weight with respect to the total weight of the charge transport layer.

In addition, it is preferable that the content of the silica particles be greater than that of the charge transport material.

When the content of the silica particles is in the above-described range, the cracking of the inorganic protective layer and the generation of a residual potential are easily suppressed.

Examples of the binder resin included in the charge transport layer include bisphenol A or bisphenol Z polycarbonate resins. The preferable mixing ratio of the charge transport material and the binder resin is, for example, from 10:1 to 1:5.

Characteristics of Charge Transport Layer

The surface roughness Ra (arithmetic average surface roughness Ra) of a surface of the charge transport layer on the side of the inorganic protective layer is preferably less than or equal to 0.06 μm, more preferably less than or equal to 0.03 μm, and still more preferably less than or equal to 0.02 μm.

When the surface roughness Ra is in the above-described range, the cleaning property is improved.

In addition, in order to control the surface roughness Ra to be in the above-described range, for example, a method of increasing the thickness of layers to be incorporated may be used.

This surface roughness Ra is measured as follows.

First, after peeling off the inorganic protective layer, a measurement target layer is exposed. A portion of the layer is cut out with a cutter or the like to obtain a measurement sample.

The surface roughness of the measurement sample is measured using a stylus type surface roughness tester (SURFCOM 1400A; manufactured by Tokyo Seimitsu Co., Ltd.) according to JIS B 0601-1994 under measurement conditions of an evaluation length Ln of 4 mm, a reference length L of 0.8 mm, and a cut-off value of 0.8 mm.

The elastic modulus of the charge transport layer is, for example, preferably greater than or equal to 5 GPa, more preferably greater than or equal to 6 GPa, and still more preferably greater than or equal to 6.5 GPa.

When the elastic modulus of the charge transport layer is in the above-described range, the cracking of the inorganic protective layer is easily suppressed.

In addition, in order to control the elastic modulus of the charge transport layer to be in the above-described range, for example, a method of adjusting the particle diameter and content of the silica particles or a method of adjusting the kind and content of the charge transport material may be used.

The elastic modulus of the charge transport layer is measured as follows.

First, the inorganic protective layer is peeled off to expose a measurement target layer. Then, a portion of the layer is cut out by a cutter or the like to obtain a measurement sample.

The depth profile of the measurement sample is obtained using NANO INDENTER SA2 (manufactured by MTS Systems Corporation) according to continuous stiffness measurement (CSM; U.S. Pat. No. 4,848,141). The elastic modulus is obtained using the average of values measured at an indentation depth of 30 nm to 100 nm.

The thickness of the charge transport layer is, for example, preferably from 10 μm to 40 μm, more preferably from 10 μm to 35 μm, and still more preferably from 15 μm to 30 μm.

When the thickness of the charge transport layer is in the above-described range, the cracking of the inorganic protective layer and the generation of a residual potential are easily suppressed.

Formation of Charge Transport Layer

A method of forming the charge transport layer is not particularly limited, and well-known formation methods are used. For example, the charge transport layer may be formed by forming a coating film of a charge transport layer-forming coating solution in which the above-described components are added to a solvent; drying the coating film; and optionally heating the coating film.

Examples of a method of coating the charge transport layer-forming coating solution on the charge generation layer include a dip coating method, a push-up coating method, a wire-bar coating method, a spray coating method, a blade coating method, a knife coating method, and a curtain coating method.

When particles (for example, silica particles and fluororesin particles) are dispersed in the charge transport layer-forming coating solution, examples of a dispersing method thereof include methods using medium dispersers such as a ball mill, a vibration ball mill, an attritor, a sand mill, and a horizontal sand mill; and mediumless dispersers such as a stirrer, an ultrasonic disperser, a roll mill, or a high-pressure homogenizer. Examples of the high-pressure homogenizer include a collision type dispersing a dispersion in a high-pressure state through liquid-liquid collision or liquid-wall collision; and a pass-through type dispersing a dispersion by causing it to pass through a fine flow path in a high-pressure state.

Inorganic Protective Layer

Composition of Inorganic Protective Layer

The inorganic protective layer includes an inorganic material.

From the viewpoints of having a mechanical strength and translucency as the protective layer, examples of the inorganic material include oxide-based, nitride-based, carbon-based, and silicon-based inorganic materials.

Examples of the oxide-based inorganic materials include metal oxides such as gallium oxide, aluminum oxide, zinc oxide, titanium oxide, indium oxide, tin oxide, and boron oxide; and mixed crystals thereof.

Examples of the nitride-based inorganic materials include metal nitrides such as gallium nitride, aluminum nitride, zinc nitride, titanium nitride, indium nitride, tin nitride, and boron nitride; and mixed crystals thereof.

Examples of the carbon-based and silicon-based inorganic materials include diamond-like carbon (DLC), amorphous carbon (a-C), amorphous hydrogenated carbon (a-C:H), amorphous hydrogenated and fluorinated carbon (a-C:F:H), amorphous silicon carbide (a-SiC), amorphous hydrogenated silicon carbide (a-SiC:H), amorphous silicon (a-Si), and amorphous hydrogenated silicon (a-Si:H).

The inorganic material may be a mixed crystal of oxide-based and nitride-based inorganic materials.

Among these, metal oxides are preferable as the inorganic material from the viewpoints of mechanical strength and translucency. In particular, an oxide of an element belonging to Group 13 (preferably, gallium oxide) is preferable from the viewpoint of obtaining n-type conductivity and superior conductivity controllability thereof.

That is, it is preferable that the inorganic protective layer contains at least an element belonging to Group 13 (in particular, gallium) and oxygen, and optionally may further contain hydrogen. By adding hydrogen thereto, the respective physical properties of the inorganic protective layer, which contains at least an element belonging to Group 13 (in particular, gallium) and oxygen, are easily controlled. For example, in an inorganic protective layer which contains gallium, oxygen, and hydrogen (in an inorganic protective layer which contains gallium oxide containing hydrogen), the volume resistivity is easily controlled in a range of from $10^9$ Ω·cm to $10^{14}$ Ω·cm by changing the composition ratio [O]/[Ga] in a range of from 1.0 to 1.5.

In order to control conductivity type, the inorganic protective layer may further include, in addition to the above inorganic materials, for example, in the case of n-type, at least one element selected from C, Si, Ge, and Sn. For example, in the case of p-type, the inorganic protective layer may further include at least one element selected from N, Be, Mg, Ca, and Sr.

When the inorganic protective layer includes gallium and oxygen and optionally further include hydrogen, the desired element composition ratio is as follows from the viewpoints of having a superior mechanical strength, translucency, and flexibility and having superior conductivity controllability thereof.

The elemental component ratio of gallium is, for example, preferably from 15 at % to 50 at %, more preferably from 20 at % to 40 at %, and still more preferably from 20 at % to 30 at % with respect to all the elemental components of the inorganic protective layer.

The elemental component ratio of oxygen is, for example, preferably from 30 at % to 70 at %, more preferably from 40 at % to 60 at %, and still more preferably from 45 at % to 55 at % with respect to all the elemental components of the inorganic protective layer.

The elemental component ratio of hydrogen is, for example, preferably from 10 at % to 40 at %, more preferably from 15 at % to 35 at %, and still more preferably from 20 at % to 30 at % with respect to all the elemental components of the inorganic protective layer.

The atomic ratio (oxygen/gallium) is preferably higher than 1.50 and lower than or equal to 2.20; and more preferably from 1.6 to 2.0.

The elemental component ratio, atomic ratio, and the like of each element in the inorganic protective layer are obtained by Rutherford backscattering spectrometry (hereinafter, referred to as "RBS") including the distribution in the thickness direction.

In RBS, 3SDH Pelletron (manufactured by NEC Corporation) is used as an accelerator; RBS-400 (manufactured by CE&A Co., Ltd.) is used as an end station; and 3S-R10 is used as a system. A program HYPRA (manufactured by CE&A Co., Ltd.) is used for analysis.

Measurement conditions for RBS are as follows: a He++ ion beam energy of 2.275 eV; a detection angle of 160°; and a grazing angle with respect to incident beams of about 109°.

Specifically, the RBS measurement is performed as follows.

First, He++ ion beams are vertically incident on a sample; a detector is set to 160° with respect to the ion beams; and backscattered He signals are measured. The composition ratio and layer thickness are determined from the detected energy and intensity of He. In order to improve the precision of the obtained composition ratio and layer thickness, a spectrum may be measured at two detection angles. The precision is improved by performing the measurement at two detection angles having different resolutions in the depth direction and backscattering mechanical properties; and cross-checking values thereof.

The number of He atoms which are backscattered by a target atom is determined by only three elements including 1) the atomic number of the target atom; 2) the energy of He atoms before scattering; and 3) the scattering angle.

The density is assumed by calculation from a measured composition, and the thickness is calculated using the assumed density. The error range of the density is within 20%.

The elemental component ratio of hydrogen is obtained by Hydrogen forward scattering spectrometry (hereinafter, referred to as "HFS").

In HFS measurement, 3SDH Pelletron (manufactured by NEC Corporation) is used as an accelerator; RBS-400 (manufactured by CE&A Co., Ltd.) is used as an end station; and 3S-R10 is used as a system. A program HYPRA (manufactured by CE&A Co., Ltd.) is used for analysis. Measurement conditions for HFS are as follows: a He++ ion beam energy of 2.275 eV; a detection angle of 160°; and a grazing angle with respect to incident beams of 30°.

In HFS measurement, a detector is set to 30° with respect to He++ ion beams; and a sample is set to form 75° with the normal line to pick up forward-scattered hydrogen signals of the sample. At this time, it is preferable that the detector be covered with aluminum foil to remove He atoms which are scattered along with hydrogen. For quantification, the amounts of hydrogen of a reference sample and a measurement sample are normalized with stopping power; and values thereof are compared to each other. As the reference sample, a sample obtained by ion-implanting H into Si and muscovite are used.

Muscovite is known to have a hydrogen concentration of 6.5 at %.

The amount of H adsorbed onto the outermost surface is corrected by subtracting the amount of H adsorbed onto a clean Si surface therefrom.

Characteristics of Inorganic Protective Layer

According to the purpose, the inorganic protective layer may have a component ratio distribution in a thickness direction thereof; or may have a multi-layer structure.

It is preferable that the inorganic protective layer be a non-single crystalline film such as a microcrystalline film, a polycrystalline film, or an amorphous film. Among these, an amorphous film is particularly preferable from the viewpoint of smoothness of a surface thereof; and a microcrystalline film is more preferable from the viewpoint of hardness.

A growth cross-section of the inorganic protective layer may have a columnar structure, but a high-flatness structure or an amorphous structure is preferable from the viewpoint of sliding property.

Whether the inorganic protective layer is crystalline or amorphous is identified based on whether or not there are points and lines in a diffraction image obtained by reflection high-energy electron diffraction (RHEED) measurement.

The volume resistivity of the inorganic protective layer is preferably greater than or equal to $10^6$ Ω·cm and more preferably greater than or equal to $10^8$ Ω·cm.

When the volume resistivity is in the above-described range, the flowing of charge in the in-plane direction is suppressed and a superior electrostatic latent image is easily formed.

The volume resistivity is calculated from a resistance value, measured using an LCR meter ZM2371 (manufactured by NF Corporation) under conditions of a frequency of 1 kHz and a voltage of 1 V, based on the electrode surface area and the sample thickness.

A measurement sample may be obtained by forming a film on an aluminum substrate under the same conditions as those during the formation of the inorganic protective layer as the measurement target and forming a metal electrode on the formed film by vapor deposition; or may be obtained by peeling off the inorganic protective layer from the prepared electrophotographic photoreceptor, etching a portion of the inorganic protective layer, and interposing the etched portion between a pair of electrodes.

The elastic modulus of the inorganic protective layer is preferably from 30 GPa to 80 GPa and more preferably 40 GPa to 65 GPa.

When this elastic modulus is in the above-described range, generation of concave portions (dent scratches), peeling, and cracking are easily suppressed in the inorganic protective layer.

The elastic modulus is obtained with a method in which a depth profile is obtained using NANO INDENTER SA2 (manufactured by MTS Systems Corporation) according to continuous stiffness measurement (CSM; U.S. Pat. No. 4,848,141); and the average of measured values at an indentation depth of 30 nm to 100 nm is obtained.

Measurement conditions are as follows.

Measurement environment: 23° C., 55% RH

Indenter: Diamond triangular indenter (Berkovich indenter)

Test mode: CSM mode

A measurement sample may be obtained with a method by forming a film on a substrate under the same conditions as those during the formation of the inorganic protective layer as a measurement target; or may be obtained by peeling off the inorganic protective layer from a prepared electrophotographic photoreceptor and etching a portion of the inorganic protective layer.

The thickness of the inorganic protective layer is, for example, preferably from 0.2 μm to 10.0 μm and more preferably from 0.4 μm to 5.0 μm.

When the thickness is in the above-described range, generation of concave portions (dent scratches), peeling, and cracking are easily suppressed in the inorganic protective layer.

Formation of Inorganic Protective Layer

In order to form the inorganic protective layer, for example, a well-known vapor deposition method such as plasma chemical vapor deposition (CVD), organometallic vapor phase epitaxy, molecular beam epitaxy, vapor deposition, or sputtering is used.

Hereinbelow, the formation of the inorganic protective layer will be described using a specific example while illustrating an example of a film forming device in the drawings. In the following description, a formation method of the inorganic protective layer which contains gallium, oxygen, and hydrogen will be described, but the formation method is not limited thereto. A well-known formation method may be adopted according to the composition of a desired inorganic protective layer.

Figure 4A:
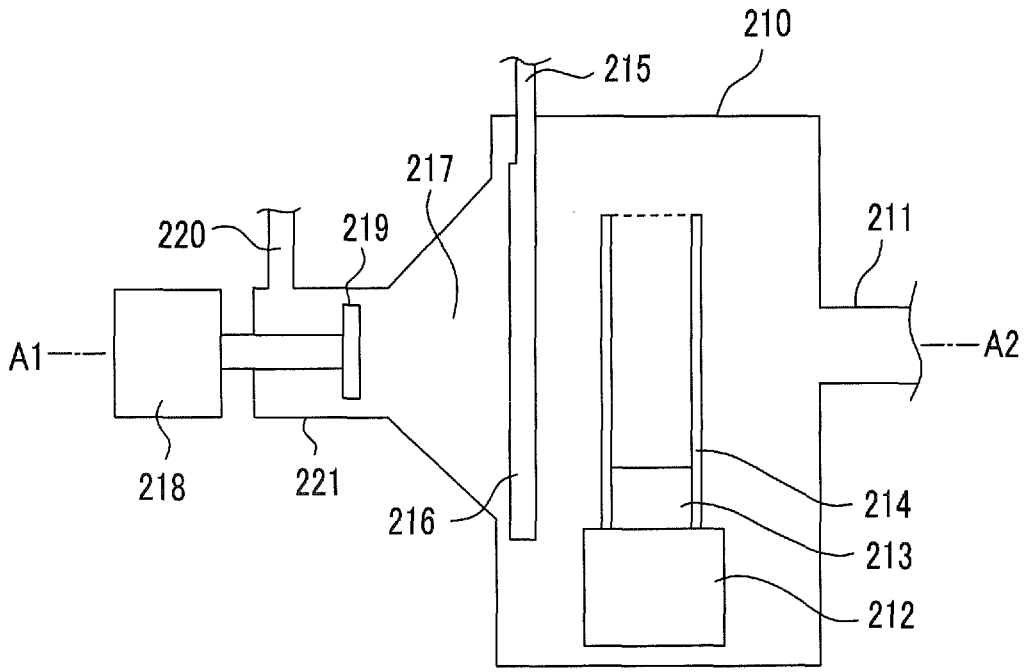
FIGS. 4A and 4B are diagrams schematically illustrating an example of a film forming device which is used for forming an inorganic protective layer of the electrophotographic photoreceptor according to the exemplary embodiment.
Figure 4B:
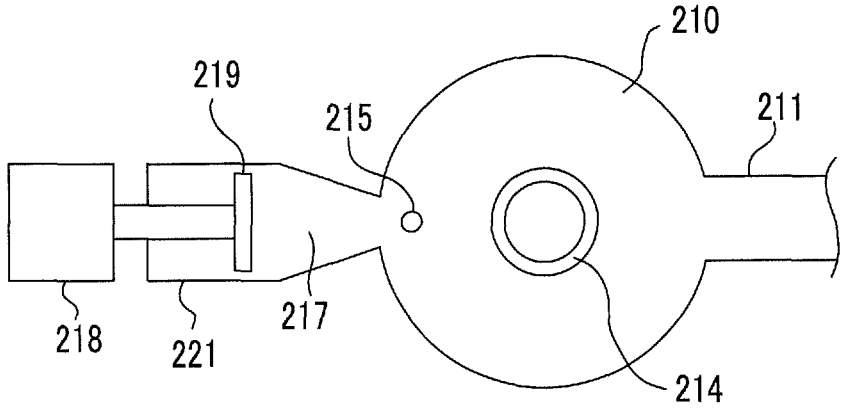

FIGS. 4A and 4B are diagrams schematically illustrating an example of a film forming device which is used for forming an inorganic protective layer of the electrophotographic photoreceptor according to the exemplary embodiment. FIG. 4A is a cross-sectional view schematically illustrating the film forming device when seen from a side, and FIG. 4B is a cross-sectional view taken along line A1-A2 schematically illustrating the film forming device illustrated in FIG. 4A. In FIGS. 4A and 4B, reference numeral 210 represents a film forming chamber; reference numeral 211 represents an exhaust port; reference numeral 212 represents a substrate rotating portion; reference numeral 213 represents a substrate support member; reference numeral 214 represents a substrate; reference numeral 215 represents a gas introduction tube; reference numeral 216 represents a shower nozzle having an opening which discharges gas introduced from the gas introduction tube 215; reference numeral 217 represents a plasma diffusion portion; reference numeral 218 represents a high-frequency power supply; reference numeral 219 represents a plate electrode; reference numeral 220 represents a gas introduction tube; and reference numeral 221 represents a high-frequency discharge tube.

In the film forming device illustrated in FIGS. 4A and 4B, the exhaust port 211 that is connected to a vacuum pump (not illustrated) is provided at an end of the film forming chamber 210; and a plasma generating device including the high-frequency power supply 218, the plate electrode 219, and the high-frequency discharge tube 221 is provided on the opposite side of the film forming chamber 210 to the side where the exhaust port 211 is provided.

This plasma generating device includes the high-frequency discharge tube 221; the plate electrode 219 that is arranged inside the high-frequency discharge tube 221 and has a discharge surface provided on the side of the exhaust port 211; and the high-frequency power supply 218 that is arranged outside the high-frequency discharge tube 221 and is connected to the opposite surface to the discharge surface of the plate electrode 219. The high-frequency discharge tube 221 is connected to one end of a gas introduction tube 220 for supplying gas into the high-frequency discharge tube 221; and a first gas supply source (not illustrated) is connected to the other end of the gas introduction tube 220.

Figure 5:
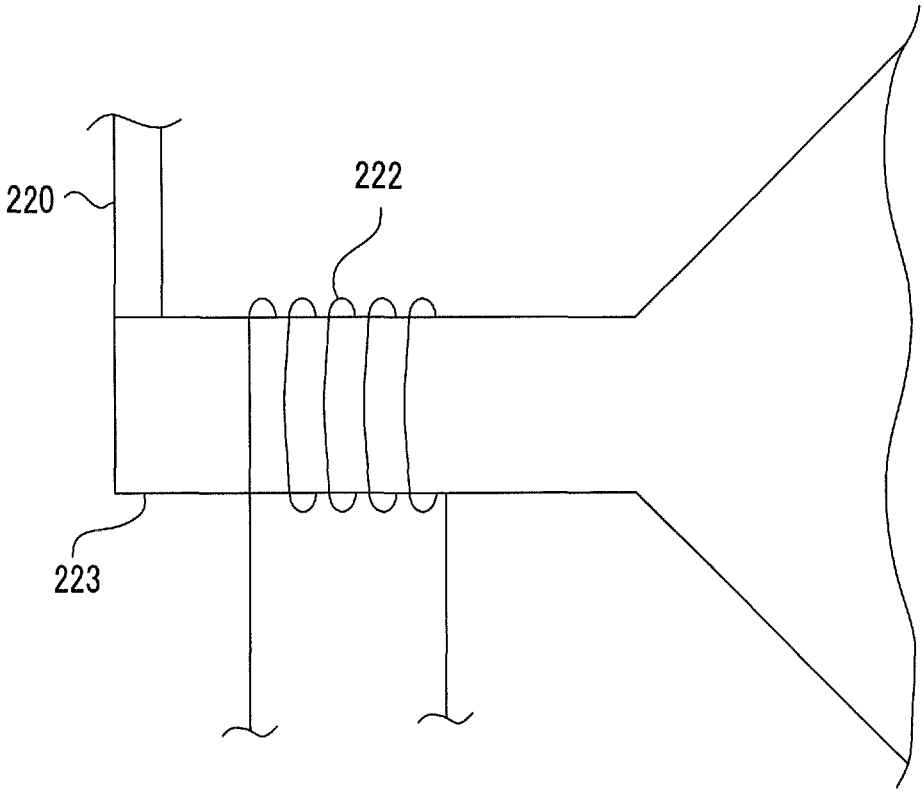
FIG. 5 is a diagram schematically illustrating an example of a plasma generating device which is used for forming the inorganic protective layer of the electrophotographic photoreceptor according to the exemplary embodiment.

A plasma generating device illustrated in FIG. 5 may be used instead of the plasma generating device which is provided in the film forming device illustrated in FIGS. 4A and 4B. FIG. 5 is a diagram schematically illustrating another example of a plasma generating device which is used in the film forming device illustrated in FIGS. 4A and 4B; and is a side view of the plasma generating device. In FIG. 5, reference numeral 222 represents a high-frequency coil; reference numeral 223 represents a quartz tube; and reference numeral 220 represents the same component as that of FIGS. 4A and 4B. This plasma generating device includes the quartz tube 223 and the high-frequency coil 222 that is provided on an outer peripheral surface of the quartz tube 223. The film forming chamber 210 (not illustrated in FIG. 5) is connected to one end of the quartz tube 223. In addition, the gas introduction tube 220 for supplying gas into the quartz tube 223 is connected to the other end of the quartz tube 223.

In FIGS. 4A and 4B, the rod-like shower nozzle 216 that extends along the discharge surface is connected to the discharge surface side of the plate electrode 219; the gas introduction tube 215 is connected to one end of the shower nozzle 216; and this gas introduction tube 215 is connected to a second gas supply source (not illustrated) that is provided outside the film forming chamber 210.

In addition, in the film forming chamber 210, the substrate rotating portion 212 is provided; and the cylindrical substrate 214 is attached to the substrate rotating portion 212 through the substrate support member 213 such that a longitudinal direction of the shower nozzle 216 and an axial direction of the substrate 214 face to each other in parallel. When a film is formed, the substrate rotating portion 212 rotates to rotate the substrate 214 in a circumferential direction thereof. As the substrate 214, a photoreceptor in which layers are laminated up to the organic photosensitive layer in advance or the like is used.

The inorganic protective layer is formed, for example, as follows.

First, oxygen gas (or helium (He)-diluted oxygen gas), helium (He) gas, and optionally hydrogen ($H_2$) gas are introduced from the gas introduction tube 220 to the high-frequency discharge tube 221 while supplying 13.56 MHz radio waves from the high-frequency power supply 218 to the plate electrode 219. At this time, the plasma diffusion portion 217 is formed so as to radially spread from the discharge surface side of the plate electrode 219 toward the exhaust port 211 side. Gas, introduced from the gas introduction tube 220, flows through the film forming chamber 210 from the plate electrode 219 side toward the exhaust port 211 side. The plate electrode 219 may be surrounded by a ground shield.

Next, trimethylgallium gas is introduced into the film forming chamber 210 through the gas introduction tube 215 and the shower nozzle 216 that is located downstream of the plate electrode 219 which is an activation unit. As a result, a non-single crystalline film containing gallium, oxygen, and hydrogen is formed on a surface of the substrate 214.

As the substrate 214, for example, a substrate on which the organic photosensitive layer is formed is used.

When the inorganic protective layer is formed, the surface temperature of the substrate 214 is preferably lower than or equal to 150° C., more preferably lower than or equal to 100° C., and still more preferably from 30° C. to 100° C. because an organic photoreceptor having the organic photosensitive layer is used.

Even when the surface temperature of the substrate 214 is lower than or equal to 150° C. in the initial stage of the film formation, the surface temperature may become higher than 150° C. due to effects of plasma and thus the organic photosensitive layer may be damaged by heat. Therefore, it is preferable that the surface temperature of the substrate 214 be controlled in consideration of the effects.

The surface temperature of the substrate 214 may be controlled by a heating and/or cooling unit (not illustrated); or may be naturally increased during an electric discharge. When the substrate 214 is heated, a heater may be provided inside or outside the substrate 214. When the substrate 214 is cooled, gas or liquid for cooling may be circulated inside the substrate 214.

When it is desired to avoid an increase in the surface temperature of the substrate 214 caused by an electric discharge, it is effective to adjust high-energy gas flow in contact with the surface of the substrate 214. In this case, conditions such as a gas flow rate, a discharge power, and a pressure are adjusted so as to obtain a desired temperature.

In addition, instead of trimethylgallium gas, an organometallic compound containing aluminum or a hydride such as diborane may be used; or a mixture of two or more kinds thereof may be used.

For example, in the initial stage of forming the inorganic protective layer, trimethylindium gas is introduced into the film forming chamber 210 through the gas introduction tube 215 and the shower nozzle 216 to form a film containing nitrogen and indium on the substrate 214. In this case, this film absorbs ultraviolet rays that are generated during continuous film formation and impair the organic photosensitive layer. Therefore, the organic photosensitive layer is inhibited from being damaged by ultraviolet rays generated during film formation.

In addition, in a doping method of a dopant during film formation, $SiH_3$ or $SnH_4$ in the gas state is used for an n-type dopant; and bis-cyclopentadienyl magnesium, dimethyl calcium, dimethyl strontium, or the like in the gas state is used for a p-type dopant. In addition, in order to dope the surface layer with a dopant element, a well-known method such as a thermal diffusion method or an ion implantation method may be used.

Specifically, gas which contains, for example, at least one or more dopant elements is introduced into the film forming chamber 210 through the gas introduction tube 215 and the shower nozzle 216 to obtain the inorganic protective layer having conductivity types of n-type, p-type, and the like.

In the film forming device described using FIGS. 4A, 4B, and 5, active nitrogen or active hydrogen generated by discharge energy may be independently controlled by plural activation devices; or gas containing both nitrogen atoms and hydrogen atoms such as $NH_3$ may be used. Furthermore, $H_2$ may be added thereto. In addition, conditions under which active hydrogen is isolated from an organometallic compound may be used.

By doing so, carbon atoms, gallium atoms, nitrogen atoms, hydrogen atoms, and the like, which are activated and controlled, are present on a surface of the substrate 214. Activated hydrogen atoms have an effect of removing, as a molecule, hydrogen of a hydrocarbon group such as a methyl group or an ethyl group included in an organometallic compound.

Therefore, a hard film (inorganic protective layer) having a three-dimensional bond is formed.

As a plasma generating unit of the film forming device illustrated in FIGS. 4A, 4B, and 5, a high-frequency oscillator is used, but the plasma generating unit is not limited thereto. For example, a microwave oscillator, an electron cyclotron resonance type device, or a helicon plasma type device may be used. In addition, examples of the high-frequency oscillator include an inductor oscillator or a capacitor oscillator.

Furthermore, two or more types of devices may be used in combination; or two or more devices of the same type may be used. In order to suppress an increase in the surface temperature of the substrate 214 caused by plasma irradiation, a high-frequency oscillator is preferable. However, a device that suppresses heat radiation may be provided.

When two or more different types of plasma generating devices (plasma generating units) are used, it is preferable that an electric discharge simultaneously occur under the same pressure. In addition, a pressure in a discharge region and a pressure in a film forming region (in which the substrate is installed) may be different from each other. These devices may be arranged in series with gas flow flowing toward the inside of the film forming device from a gas introduction portion to a gas discharge portion; or all the devices may be arranged opposite a film forming surface of the substrate.

For example, a case in which two or more types of plasma generating units are arranged in series with gas flow will be described using the film forming device illustrated in FIGS. 4A and 4B as an example. In this case, the shower nozzle 216 is used as an electrode and as a second plasma generating device which causes an electric discharge to occur in the film forming chamber 210. In this case, a high-frequency voltage is applied to the shower nozzle 216 through, for example, the gas introduction tube 215. As a result, an electric discharge occurs in the film forming chamber 210 using the shower nozzle 216 as an electrode. Alternatively, instead of using the shower nozzle 216 as an electrode, a cylindrical electrode is provided between the substrate 214 and the plate electrode 219 in the film forming chamber 210; and this cylindrical electrode is used to cause an electric discharge to occur in the film forming chamber 210.

In addition, a case in which two different types of plasma generating devices are used under the same pressure will be described. For example, when a microwave oscillator and a high-frequency oscillator are used, the excitation energy of excited species may be greatly changed, which is effective for controlling film quality. In addition, an electric discharge may be performed under about the atmospheric pressure (from 70,000 Pa to 110,000 Pa). When an electric discharge is performed under about the atmospheric pressure, it is preferable that He be used as a carrier gas.

The inorganic protective layer is formed by providing the substrate 214 on which the organic photosensitive layer is formed in the film forming chamber 210 and introducing mixed gas having different compositions thereinto.

In addition, for example, when a high-frequency discharge is used as film forming conditions, it is preferable that the frequency be in a range of from 10 kHz to 50 MHz in order to form a high-quality film at a low temperature. In addition, although depending on the size of the substrate 214, it is preferable that the power be in a range of from 0.01 $W/cm^2$ to 0.2 $W/cm^2$ with respect to the surface area of the substrate. It is preferable that the rotating speed of the substrate 214 be from 0.1 rpm to 500 rpm.

Hereinabove, the electrophotographic photoreceptor, in which the organic photosensitive layer is a function separation type; and the charge transport layer is configured as a single layer, have been described as an example. In the case of the electrophotographic photoreceptor (example in which the organic photosensitive layer is a function separation type; and the charge transport layer is configured as multiple layers) illustrated in FIG. 2, it is preferable that the charge generation layer 3A in contact with the inorganic protective layer 5 have the same configuration as that of the charge transport layer 3 of the electrophotographic photoreceptor illustrated in FIG. 1; and the charge transport layer 3B not being in contact with the inorganic protective layer 5 have the same configuration as that of a well-known charge transport layer.

In this case, the thickness of the charge generation layer 3A is preferably from 1 μm to 15 μm; and the thickness of the charge transport layer 3B is preferably from 15 μm to 29 μm.

Meanwhile, in the case of the electrophotographic photoreceptor (example in which the organic photosensitive layer is configured as a single layer) illustrated in FIG. 3, it is preferable that the single-layer type organic photosensitive layer 6 (charge generation and charge transport layer) have the same configuration as that of the charge transport layer 3 of the electrophotographic photoreceptor except that it includes the charge generation material.

In this case, the content of the charge generation material in the single-layer type organic photosensitive layer 6 is preferably from 25% by weight to 50% by weight with respect to the total weight of the single-layer type organic photosensitive layer.

In addition, the thickness of the single-layer type organic photosensitive layer 6 is preferably from 15 μm to 30 μm.

Process Cartridge and Image Forming Apparatus

Figure 6:
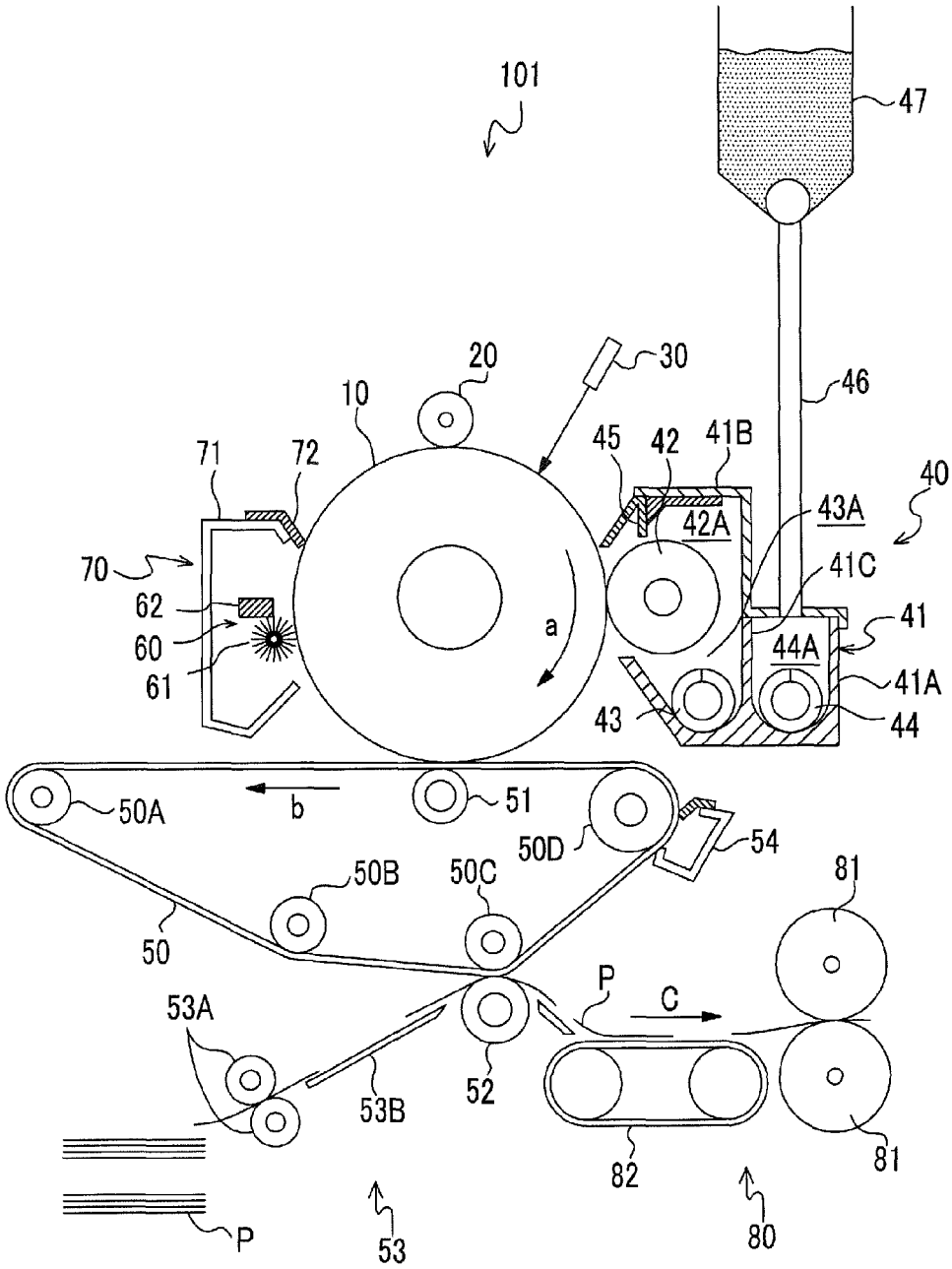
FIG. 6 is a diagram schematically illustrating a configuration example of an image forming apparatus according to an exemplary embodiment of the present invention.

FIG. 6 is a diagram schematically illustrating a configuration example of an image forming apparatus according to an exemplary embodiment of the invention.

As shown in FIG. 6, an image forming apparatus 101 according to this exemplary embodiment is provided with, for example, an electrophotographic photoreceptor 10 (the electrophotographic photoreceptor according to the above-described exemplary embodiment) that rotates in a clockwise direction as shown by the arrow a, a charging device 20 (an example of charging unit) that is provided above the electrophotographic photoreceptor 10 to face the electrophotographic photoreceptor 10 and charges a surface of the electrophotographic photoreceptor 10, an exposure device 30 (an example of electrostatic latent image forming unit) that exposes the surface of the electrophotographic photoreceptor 10 charged by the charging device 20 to form an electrostatic latent image, a developing device 40 (an example of developing unit) that adheres a toner contained in a developer to the electrostatic latent image formed using the exposure device 30 to form a toner image on the surface of the electrophotographic photoreceptor 10, a belt-shaped intermediate transfer member 50 that moves to a direction indicated by arrow b while being in contact with the electrophotographic photoreceptor 10 and transfers the toner image, formed on the electrophotographic photoreceptor 10, onto a recording medium, and a cleaning device 70 (an example of a cleaning unit) that cleans the surface of the electrophotographic photoreceptor 10.

The charging device 20, the exposure device 30, the developing device 40, the intermediate transfer member 50, a lubricant supply device 60, and the cleaning device 70 are arranged clockwise on a circle surrounding the electrophotographic photoreceptor 10. In the exemplary embodiment, the lubricant supply device 60 is arranged inside the cleaning device 70, but the exemplary embodiment is not limited thereto. The lubricant supply device 60 may be arranged separately from the cleaning device 70.

The intermediate transfer member 50 is held from its inside by support rollers 50A and 50B, a rear surface roller 50C and a drive roller 50D while a tension is applied thereto; and is driven in a direction indicated by arrow b along with the rotation of the drive roller 50D. At a position in the intermediate transfer member 50 opposite the electrophotographic photoreceptor 10, a primary transfer device 51 that charges the intermediate transfer member 50 to a different polarity from that of a toner to adsorb the toner, located on the electrophotographic photoreceptor 10, to an outside surface of the intermediate transfer member 50 is provided. On the lower outside of the intermediate transfer member 50, a secondary transfer device 52 that charges a recording paper P (an example of the recording medium) to a different polarity from that of the toner to transfer a toner image, formed on the intermediate transfer member 50, onto the recording paper P is provided opposite the rear surface roller 50C. These members for transferring the toner image, formed on the electrophotographic photoreceptor 10, onto the recording paper P correspond to an example of the transfer unit.

Below the intermediate transfer member 50, a recording paper supply device 53 that supplies the recording paper P to the secondary transfer device 52; and a fixing device 80 that fixes the toner image, while transporting the recording paper P on which the toner image is formed by the secondary transfer device 52.

The recording paper supply device 53 includes a pair of transport rollers 53A; and a guide slope 53B that guides the recording paper P, transported by the transport roller 53A, to the secondary transfer device 52. The fixing device 80 includes fixing rollers 81 that are a pair of heat rollers and heat and press the recording paper P, onto which the toner image is transferred by the secondary transfer device 52, to fix the toner image thereon; and a transport conveyor 82 that transports the recording paper P to the fixing rollers 81.

The recording paper P is transported in the direction indicated by arrow c by the recording paper supply device 53, the secondary transfer device 52, and the fixing device 80.

In the intermediate transfer member 50, an intermediate transfer member cleaning device 54 that includes a cleaning blade, which removes toner remaining on the intermediate transfer member 50 after the toner image is transferred onto the recording paper P by the secondary transfer device 52, is provided.

Hereinafter, major components of the image forming apparatus 101 according to an exemplary embodiment of the invention will be described in detail.

Charging Device

Examples of the charging device 20 include contact-type charging units using a conductive charging roller, a charging brush, a charging film, a charging rubber blade, and a charging tube. In addition, examples of the charging device 20 also include well-known charging units such as non-contact-type roller charging units, and scorotron charging units and corotron charging units using corona discharge. A contact-type charging unit is preferable as the charging device 20.

Exposure Device

Examples of the exposure device 30 include optical equipment that exposes the surface of the electrophotographic photoreceptor 10 with light such as semiconductor laser light, LED light, or liquid crystal shutter light in the form of an image. The wavelength of a light source is preferably in the spectral sensitivity region of the electrophotographic photoreceptor 10. As for the wavelength of the semiconductor laser, for example, a near-infrared laser having an oscillation wavelength of approximately 780 nm may be preferably used. However, the wavelength is not limited thereto, and a laser having an oscillation wavelength of about 600 nm or a laser having an oscillation wavelength of 400 nm to 450 nm as a blue laser may also be used. In addition, as the exposure device 30, it is also effective to use a surface-emitting laser light source that outputs multi-beams in order to form a color image for example.

Developing Device

The developing device 40 is arranged in a development region, for example, to face the electrophotographic photoreceptor 10. The developing device 40 includes a developer container (developing device main body) 41 that accommodates, for example, a two-component developer containing a toner and a carrier; and a replenishment developer container (toner cartridge) 47. The developer container 41 includes a developer container main body 41A; and developer container cover 41B that covers an upper end of the developer container main body 41A.

The developer container main body 41A includes, for example, a developing roller chamber 42A that accommodates a developing roller 42; a first stirring chamber 43A that is provided adjacent to the developing roller chamber 42A; and a second stirring chamber 44A that is provided adjacent to the first stirring chamber 43A. In addition, in the developing roller chamber 42A, a layer thickness regulating member 45 that regulates the thickness of a developer layer on the surface of the developing roller 42 is provided, for example, when the developer container cover 41B is mounted to the developer container main body 41A.

The first stirring chamber 43A and the second stirring chamber 44A are partitioned by, for example, a partition wall 41C. Although not shown, the first stirring chamber 43A and the second stirring chamber 44A are connected to each other through openings which are provided at both ends of the partition wall 41C in a longitudinal direction thereof (longitudinal direction of the developing device). The first stirring chamber 43A and the second stirring chamber 44A form a circulation stirring chamber (43A+44A).

In the developing roller chamber 42A, the developing roller 42 is arranged opposite the electrophotographic photoreceptor 10. In the developing roller 42, a sleeve is provided outside a magnetic roller (not illustrated; stationary magnet).

A developer in the first stirring chamber 43A is adsorbed onto a surface of the developing roller 42 by a magnetic force of the magnetic roller and is transported to the development region. In addition, a roller shaft of the developing roller 42 is rotatably supported by the developer container main body 41A. The developing roller 42 and the electrophotographic photoreceptor 10 rotate in the same direction. On the opposite side thereto, the developer adsorbed onto the surface of the developing roller 42 is transported to the development region from the opposite direction to the rotating direction of the electrophotographic photoreceptor 10.

In addition, a bias power supply (not illustrated) is connected to the sleeve of the developing roller 42 to apply a developing bias thereto (in the exemplary embodiment, a bias in which a direct current (DC) component and an alternating current (AC) component are superimposed on each other is applied so as to apply an alternating electric filed to the development region).

In the first stirring chamber 43A and the second stirring chamber 44A, a first stirring member 43 (stirring and transporting member) and a second stirring member 44 (stirring and transporting member) that transport the developer while stirring the developer are provided, respectively. The first stirring member 43 includes a first rotating shaft that extends in an axial direction of the developing roller 42; and a stirring and transporting blade (protrusion) that is fixed to an outer circumference of the rotating shaft in a spiral shape. Likewise, the second stirring member 44 also includes a second rotating shaft and a stirring and transporting blade (protrusion). The stirring members are rotatably supported by the developer container main body 41A. The first stirring member 43 and the second stirring member 44 are arranged such that the developer in the first stirring chamber 43A and the second stirring chamber 44A is transported in opposite directions to each other due to their rotation.

One end of a replenishing path 46 that supplies a replenishment developer containing a replenishment toner and a replenishment carrier to the second stirring chamber 44A is connected to one end of the second stirring chamber 44A in the longitudinal direction; and the other end of the replenishing path 46 is connected to a replenishment developer container 47 that accommodates the replenishment developer.

In this way, the replenishment developer is supplied from the replenishment developer container (toner cartridge) 47 to the developing device 40 (the second stirring chamber 44A) through the replenishing path 46.

Examples of the developer used in the developing device 40 include well-known developers such as a single-component developer containing a toner alone and a two-component developer containing a toner and a carrier.

Transfer Device

Examples of the primary transfer device 51 and the secondary transfer device 52 include well-known transfer charging units such as contact-type transfer charging units using a belt, a roller, a film, a rubber blade, and the like; and scorotron transfer units and corotron transfer units using corona discharge.

Examples of the intermediate transfer member 50 include a belt-shaped member (intermediate transfer belt) that contains a conductive agent and is formed of polyimide, polyamidimide, polycarbonate, polyarylate, polyester, or rubber. In addition, the intermediate transfer member may have a cylindrical shape in addition to a belt shape.

Cleaning Device

The cleaning device 70 includes, for example, a housing 71, a cleaning blade 72 that projects from the housing 71, and a lubricant supply device 60 that is arranged downstream of the cleaning blade 72 in the rotation direction of the electrophotographic photoreceptor 10.

In addition, the cleaning blade 72 may be supported at the edge portion of the housing 71, or may be separately supported by a support member (holder). This embodiment shows a configuration in which the cleaning blade 72 is supported at the edge portion of the housing 71.

First, the cleaning blade 72 will be described.

Examples of a material of the cleaning blade 72 (a cleaning layer 72A and a rear surface layer 72B) include urethane rubber, silicone rubber, fluorine rubber, propylene rubber, and butadiene rubber. Among these, urethane rubber is preferable.

Urethane rubber (polyurethane) is not particularly limited as long as it is generally used for forming polyurethane, and preferable examples thereof include urethane rubbers which are obtained by using, as raw materials, urethane prepolymers composed of a polyol such as a polyester polyol (for example, polyethylene adipate or polycaprolactone) and an isocyanate such as diphenylmethane diisocyanate; and a crosslinking agent such as 1,4-butanediol, trimethylolpropane, ethylene glycol, or a mixture thereof.

Next, the lubricant supply device 60 will be described.

For example, the lubricant supply device 60 is provided inside the cleaning device 70 and upstream of the cleaning blade 72 in the rotating direction of the electrophotographic photoreceptor 10.

For example, the lubricant supply device 60 includes a rotating brush 61 that is arranged in contact with the electrophotographic photoreceptor 10; and a solid lubricant 62 that is arranged in contact with the rotating brush 61. In the lubricant supply device 60, the rotating brush 61 rotates in a state of being in contact with the solid lubricant 62 to attach the lubricant 62 to the rotating brush 61; the attached lubricant 62 is supplied to a surface of the electrophotographic photoreceptor 10 to form a film of the lubricant 62.

The lubricant supply device 60 is not limited to the above-described configuration, and a rubber roller may be used instead of the rotating brush 61, for example.

Operation of the Image Forming Apparatus

Hereinafter, the operation of the image forming apparatus 101 according to this exemplary embodiment will be described. First, when being rotated in the direction indicated by arrow a, the electrophotographic photoreceptor 10 is negatively charged by the charging device 20 at the same time.

The electrophotographic photoreceptor 10, the surface of which has been negatively charged by the charging device 20, is exposed using the exposure device 30, and a latent image is formed on the surface thereof.

When a part in the electrophotographic photoreceptor 10, in which the latent image has been formed, approaches the developing device 40, the developing device 40 (developing roll 42) adheres a toner to the latent image to form a toner image.

When the electrophotographic photoreceptor 10 on which the toner image is formed further rotates in the direction indicated by arrow a, the toner image is transferred onto the outside surface of the intermediate transfer member 50.

Once the toner image is transferred onto the intermediate transfer member 50, the recording paper P is supplied to the secondary transfer device 52 by the recording paper supply device 53. The toner image, transferred onto the intermediate transfer member 50, is transferred onto the recording paper P by the secondary transfer device 52. As a result, the toner image is formed on the recording paper P.

The toner image, formed on the recording paper P, is fixed on the recording paper P by the fixing device 80.

After the toner image is transferred onto the intermediate transfer member 50, the lubricant 62 is supplied to a surface of the electrophotographic photoreceptor 10 by the lubricant supply device 60 to form a film of the lubricant 62 on the surface of the electrophotographic photoreceptor 10. Then, toner and corona products remaining on the surface are removed by the cleaning blade 72 of the cleaning device 70. After the toner image is transferred, the electrophotographic photoreceptor 10, from which the remaining toner and the corona products are removed by the cleaning device 70, is charged again by the charging device 20; and is exposed to light by the exposure device 30 to form a latent image thereon.

Figure 7:
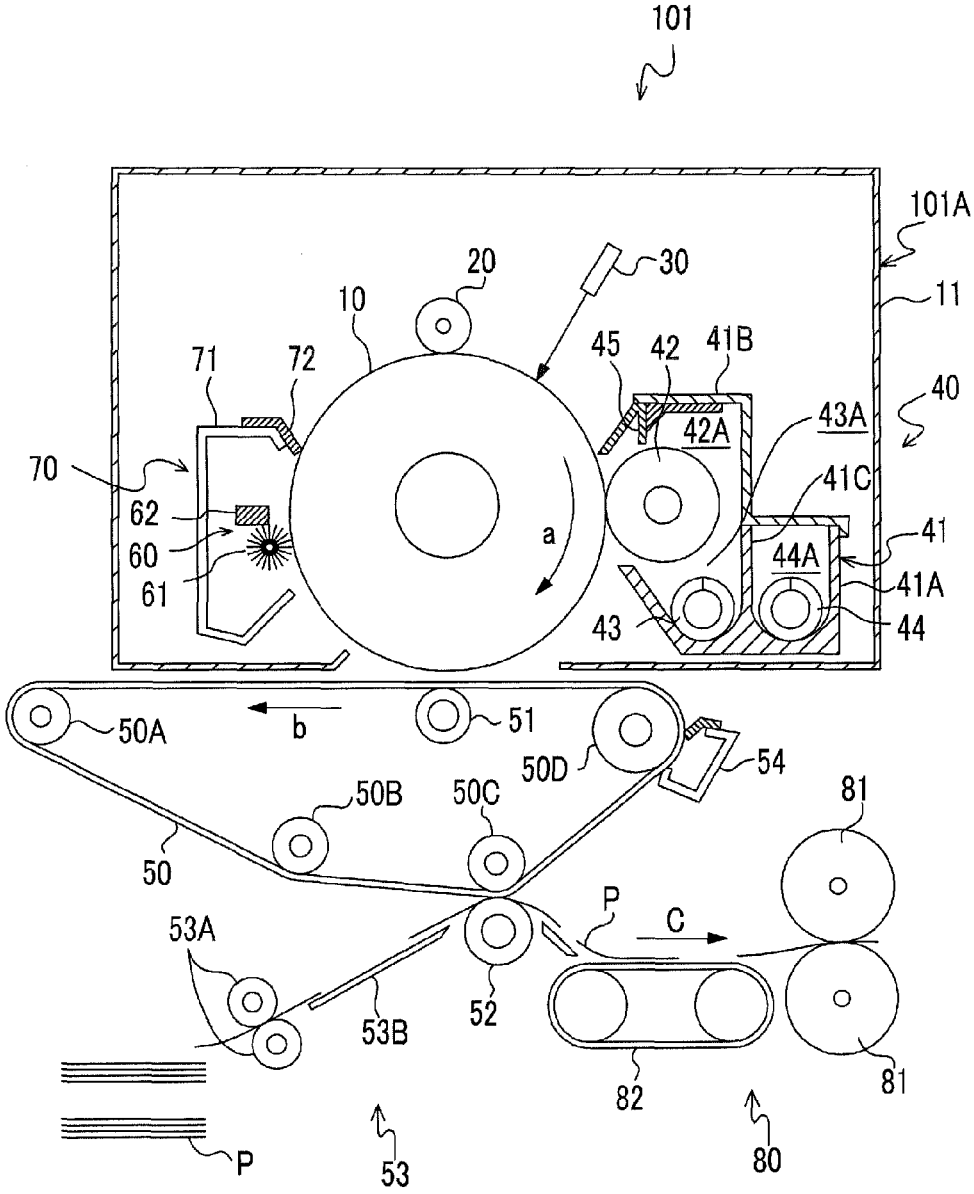
FIG. 7 is a diagram schematically illustrating another configuration example of the image forming apparatus according to the exemplary embodiment.

In addition, as illustrated in FIG. 7, for example, the image forming apparatus 101 according to the exemplary embodiment may include a process cartridge 101A in which the electrophotographic photoreceptor 10, the charging device 20, the developing device 40, the lubricant supply device 60, and the cleaning device 70 are integrally housed in a housing 11. This process cartridge 101A integrally houses plural members and is detachable from the image forming apparatus 101. In the developing device 40 of the image forming apparatus 101 illustrated in FIG. 7, the replenishment developer container 47 is not provided.

The process cartridge 101A is not limited to the above configuration as long as it includes at least the electrophotographic photoreceptor 10, and may further include at least one selected from the charging device 20, the exposure device 30, the developing device 40, the primary transfer device 51, the lubricant supply device 60, and the cleaning device 70.

In addition, the image forming apparatus 101 according to the exemplary embodiment is not limited to the above-described configurations. For example, a first erasing device for aligning the polarity of remaining toner and facilitating the cleaning brush to remove the remaining toner may be provided downstream of the primary transfer device 51 in the rotating direction of the electrophotographic photoreceptor 10 and upstream of the cleaning device 70 in the rotating direction of the electrophotographic photoreceptor 10 in the vicinity of the electrophotographic photoreceptor 10; or a second erasing device for erasing the charge on the surface of the electrophotographic photoreceptor 10 may be provided downstream of the cleaning device 70 in the rotating direction of the electrophotographic photoreceptor 10 and upstream of the charging device 20 in the rotating direction of the electrophotographic photoreceptor 10.

In addition, the image forming apparatus 101 according to the exemplary embodiment is not limited to the above-described configurations and well-known configurations may be adopted. For example, a method of directly transferring the toner image, formed on the electrophotographic photoreceptor 10, on to the recording paper P may be adopted; or a tandem-type image forming apparatus may be adopted.

EXAMPLES

Hereinafter, the exemplary embodiments will be described in detail using examples. However, the exemplary embodiments are not limited to the examples. In the following examples, "part(s)" represents "part(s) by weight".

Preparation of Silica Particles

Silica Particle (0)

Untreated (hydrophilic) silica particles (trade name: OX50; manufactured by Japan Aerosil Co., Ltd.) is prepared as silica particles (0).

Silica Particles (11)

30 parts by weight of trimethylsilane (TMS) (trade name: 1,1,1,3,3,3-hexamethyldisilazane; manufactured by Tokyo Chemical Industry Co., Ltd.) as a hydrophobizing agent are added to 100 parts by weight of untreated (hydrophilic) silica particles (trade name: OX50; manufactured by Japan Aerosil Co., Ltd.). The reaction is continued for 24 hours, followed by filtration. As a result, hydrophobized silica particles are obtained as silica particles (11).

Silica Particles (12)

Hydrophobized silica particles (trade name: RX200; manufactured by Japan Aerosil Co., Ltd.) are prepared as silica particles (12).

Silica Particles (13)

Hydrophobized silica particles (trade name: X24-9163A; manufactured by Shin-Etsu Chemical Co., Ltd.) are prepared as silica particles (13).

Silica Particles (14)

200 parts by weight of tetrahydrofuran and 30 parts by weight of trimethylsilane (TMS) (trade name: 1,1,1,3,3,3-hexamethyldisilazane; manufactured by Tokyo Chemical Industry Co., Ltd.) as a hydrophobizing agent are added to 100 parts by weight of untreated (hydrophilic) silica particles (trade name: OX50; manufactured by Japan Aerosil Co., Ltd.). The reaction is continued for 12 hours, followed by filtration. As a result, hydrophobized silica particles are obtained as silica particles (14).

Silica Particles (15)

200 parts by weight of tetrahydrofuran and 30 parts by weight of trimethylsilane (TMS) (trade name: 1,1,1,3,3,3-hexamethyldisilazane; manufactured by Tokyo Chemical Industry Co., Ltd.) as a hydrophobizing agent are added to 100 parts by weight of untreated (hydrophilic) silica particles (trade name: SFP-20M; manufactured by Denki Kagaku Kogyo Kabushiki Kaisha). The reaction is continued for 12 hours, followed by filtration. As a result, hydrophobized silica particles are obtained as silica particles (15).

Silica Particles (21)

200 parts by weight of tetrahydrofuran and 30 parts by weight of decylsilane (DS) (decyltrimethoxysilane, trade name: KBM-3103; manufactured by Shin-Etsu Chemical Co., Ltd.) as a hydrophobizing agent are added to 100 parts by weight of untreated (hydrophilic) silica particles (trade name: OX50; manufactured by Japan Aerosil Co., Ltd.). The reaction is continued for 24 hours, followed by filtration. As a result, hydrophobized silica particles are obtained as silica particles (21).

Silica Particles (31)

200 parts by weight of tetrahydrofuran and 30 parts by weight of phenylsilane (PS) (phenyltrimethoxysilane, trade name: KBE-103; manufactured by Shin-Etsu Chemical Co., Ltd.) as a hydrophobizing agent are added to 100 parts by weight of untreated (hydrophilic) silica particles (trade name: OX50; manufactured by Japan Aerosil Co., Ltd.). The reaction is continued for 24 hours. As a result, hydrophobized silica particles are obtained as silica particles (31).

Examples A

Example A1

Preparation of Undercoat Layer 100 parts by weight of zinc oxide (average particle diameter: 70 nm, manufactured by Tayca Corporation, specific surface area: 15 $m^2/g$) is stirred and mixed with 500 parts by weight of tetrahydrofuran. 1.3 parts by weight of silane coupling agent (KBM503, manufactured by Shin-Etsu Chemical Co., Ltd.) is added thereto, followed by stirring for 2 hours. Then, tetrahydrofuran is removed by distillation under reduced pressure, followed by baking at 120° C. for 3 hours. As a result, zinc oxide of which surfaces are treated with the silane coupling agent is obtained.

110 parts by weight of the surface-treated zinc oxide is stirred and mixed with 500 parts by weight of tetrahydrofuran. A solution obtained by dissolving 0.6 parts by weight of alizarin in 50 parts by weight of tetrahydrofuran is added thereto, followed by stirring at 50° C. for 5 hours. Zinc oxide to which alizarin is added is separated by filtration under reduced pressure, followed by drying under reduced pressure at 60° C. As a result, an alizarin-added zinc oxide is obtained.

60 parts by weight of the alizarin-added zinc oxide, 13.5 parts by weight of curing agent (blocked isocyanate, SUMIDUR 3175, manufactured by Sumitomo Bayer Urethane Co., Ltd.), and 15 parts by weight of butyral resin (S-LEC BM-1, manufactured by Sekisui Chemical Co., Ltd.) are dissolved in 85 parts by weight of methyl ethyl ketone to obtain a solution. 38 parts by weight of the solution is mixed with 25 parts by weight of methyl ethyl ketone, followed by dispersion for 2 hours using a sand mill with diameter of 1 mmϕ glass beads. As a result, a dispersion is obtained.

As a catalyst, 0.005 parts by weight of dioctyl tin dilaurate and 40 parts by weight of silicone resin particles (TOSPEARL 145, manufactured by GE Toshiba Silicone Co., Ltd.) are added to the obtained dispersion to obtain an undercoat layer-forming coating solution. This coating solution is dip-coated on an aluminum substrate having a diameter of 60 mm, a length of 357 mm, and a thickness of 1 mm, followed by drying and curing at 170° C. for 40 minutes. As a result, an undercoat layer having a thickness of 19 μm is obtained.

Preparation of Charge Generation Layer 15 parts by weight of hydroxygallium phthalocyanine, as a charge generation material, having diffraction peaks at Bragg angles (2θ±0.2°) of at least 7.3°, 16.0°, 24.9°, and 28.0° in an X-ray diffraction spectrum using CuKα characteristic X-rays; 10 parts by weight of vinyl chloride-vinyl acetate copolymer resin (VMCH, manufactured by Nippon Unicar Co., Ltd.) as a binder resin; and 200 parts by weight of n-butyl acetate are mixed with each other to obtain a mixture. This mixture is dispersed for hours using a sand mill with glass beads having a diameter of 1 mmϕ to obtain a dispersion. 175 parts by weight of n-butyl acetate and 180 parts by weight of methyl ethyl ketone are added to the obtained dispersion, followed by stirring. As a result, a charge generation layer-forming coating solution is obtained. This charge generation layer-forming coating solution is dip-coated on the undercoat layer, followed by drying at normal temperature (25° C.). As a result, a charge generation layer having a thickness of 0.2 μm is formed.

Preparation of Charge Transport Layer 95 parts by weight of tetrahydrofuran is added to 20 parts by weight of the silica particles (11). While maintaining the solution temperature at 20° C., 10 parts by weight of N,N'-diphenyl-N,N'-bis(3-methylphenyl)-(1,1'-diphenyl)-4,4'-diamine, and 10 parts by weight of bisphenol Z polycarbonate resin (viscosity average molecular weight: 50,000) as a binder resin are added thereto, followed by stirring for 12 hours. As a result, a charge transport layer-forming coating solution is obtained.

This charge transport layer-forming coating solution is coated on the charge generation layer, followed by drying at 135° C. for 40 minutes. As a result, a charge transport layer having a thickness of 30 μm is formed and thus, a desired electrophotographic photoreceptor is obtained.

Through the above-described processes, an organic photoreceptor (hereinbelow, referred to as "non-coated photoreceptor (1)") in which the undercoat layer, the charge generation layer, and the charge transport layer are formed and laminated on the aluminum substrate in this order, is obtained.

Formation of Inorganic Protective Layer

Next, an inorganic protective layer, formed of gallium oxide including hydrogen, is formed on a surface of the non-coated photoreceptor (1). In order to form the inorganic protective layer, a film forming device having the configuration illustrated in FIG. 4 is used.

First, the non-coated photoreceptor (1) is placed on the substrate support member 213 in the film forming chamber 210 of the film forming device. Then, the inside of the film forming chamber 210 is evacuated through the exhaust port 211 until the pressure reaches 0.1 Pa. This evacuation is performed within 5 minutes after completing the substitution of gas containing a high concentration of oxygen.

Next, He-diluted 40% oxygen gas (flow rate: 1.6 sccm) and hydrogen gas (flow rate: 50 sccm) are introduced from the gas introduction tube 220 into the high-frequency discharge tube 221 provided with the plate electrode 219 having a diameter of 85 mm. Matching is performed using a tuner in which 13.56 MHz radio waves are set to a power of 150 W by the high-frequency power supply 218 and a matching circuit (not illustrated in FIGS. 4A and 4B). An electric discharge is caused from the plate electrode 219. At this time, the power of reflected wave is 0 W.

Next, trimethylgallium gas (flow rate: 1.9 sccm) is introduced from the shower nozzle 216 into the plasma diffusion portion 217, provided inside the film forming chamber 210, through the gas introduction tube 215. At this time, the reaction pressure in the film forming chamber 210 is 5.3 Pa when measured using a Baratron vacuum gauge.

In this state, a film is formed on the non-coated photoreceptor (1) for 68 minutes while rotating the non-coated photoreceptor (1) at a speed of 500 rpm. As a result, an inorganic protective layer having a thickness of 0.25 μm is formed on a surface of the charge transport layer of the non-coated photoreceptor (1).

Through the above-described steps, an electrophotographic photoreceptor is obtained in which the undercoat layer, the charge generation layer, the charge transport layer, and the inorganic protective layer are sequentially formed on the conductive substrate in this order.

Examples A2 to A8 and Comparative Example A1

Electrophotographic photoreceptors are obtained with the same method as that of Example A1, except that the composition and thickness of the charge transport layer are changed according to Table 2.

Evaluation A

Evaluation A for Characteristics

Regarding the electrophotographic photoreceptor obtained in each example, the elastic modulus of the charge transport layer is investigated with the above-described method.

In addition, the coating property of the electrophotographic photoreceptor obtained in each sample is evaluated as follows by visual inspection.

A: During coating, the film is not peeled off and silica particles do not precipitate B: The film is not peeled off, but the precipitation of silica particles (the cloudiness of the surface) is observed C: The film is peeled off Experimental Evaluation A The electrophotographic photoreceptor obtained in each sample is mounted onto 700 Digital Color Press (manufactured by Fuji Xerox Co., Ltd.). Using this apparatus, half-tone images (image density: 30%) are continuously printed for test in a high-temperature and high-humidity environment (20° C., 40% RH) to evaluate the scratch of the inorganic protective layer and the electrical characteristics of the photoreceptor.

Evaluation for Scratch of Inorganic Protective Layer

After continuously printing 100 half-tone images (image density: 30%), the surface of the electrophotographic photoreceptor (the surface of the inorganic protective layer) is observed and measured by a laser microscope at a magnification of 450 times in 10 visual fields to count the number of concave scratches and thus to calculate the number of scratches per unit area (1 mm×1 mm).

The evaluation criteria are as follows.

A: The number of scratches is less than or equal to 20

B: The number of scratches is more than 20 and less than or equal to 100

C: The number of scratches is more than 100

Electrical Characteristics

The electrical characteristics of the electrophotographic photoreceptor are evaluated by the measurement using a scanner. The details thereof are as follows.

1. Residual Potential (RP)

First, a surface of the electrophotographic photoreceptor, which is rotating at 167 rpm in a state of being charged to −700 V by a scorotron charging unit, is irradiated with exposure light (light source: semiconductor laser, wavelength: 780 nm, power: 5 mW) while scanning the surface of the electrophotographic photoreceptor. Then, a potential of the electrophotographic photoreceptor is measured using a surface potentiometer (Model 344, manufactured by Trek Japan Co., Ltd.) to investigate a potential state (residual potential) of the electrophotographic photoreceptor. This process is repeated 100 cycles, and a residual potential in the 100th cycle is measured.

The evaluation criteria are as follows.

A: The residual potential (RP) is lower than or equal to 100 V

B: The residual potential (RP) is higher than 100 V and lower than or equal to 150 V C: The residual potential (RP) is higher than 150 V

Examples B

Examples B1 to B5 and Comparative Examples B1 and B2

Electrophotographic photoreceptors are obtained with the same method as that of Example A1, except that the composition and thickness of the charge transport layer are changed according to Table 3.

In each example, the film forming time is changed, and the thickness of the inorganic protective layer is 1 μm.

Evaluation B

Regarding the electrophotographic photoreceptor obtained in each example, the scratch of the inorganic protective layer and the electrical characteristics of the photoreceptor are evaluated with the same method as that of Examples A.

Regarding the evaluation of Comparative Example B2 for coating property, cloudiness, caused not by the precipitation of silica particles but by the precipitation of the charge transport material, is investigated.

Examples C

Examples C1 to C3 and Comparative Example C1

20 electrophotographic photoreceptors are prepared with the same method of Example A1, except that the composition and thickness of the charge transport layer is changed according to Table 4. Among these, three electrophotographic photoreceptors having the highest value, second highest value, and average value in the surface roughness Ra of the charge transport layer are selected as the electrophotographic photoreceptors of Examples C1 to C3 for the evaluation.

Likewise, an electrophotographic photoreceptor is prepared with the same method of Example A1, except that the composition and thickness of the charge transport layer is changed according to Table 4. This electrophotographic photoreceptor is selected as the electrophotographic photoreceptor of Comparative Example C1 for the evaluation.

Evaluation C

Regarding the electrophotographic photoreceptor obtained in each example, the coating property, the scratch of the inorganic protective layer and the electrical characteristics of the photoreceptor are evaluated with the same method as that of Examples A. In addition, the cleaning property is also evaluated.

Evaluation for Cleaning Property

The electrophotographic photoreceptor obtained in each sample is mounted onto 700 Digital Color Press (manufactured by Fuji Xerox Co., Ltd.). Using this apparatus, 20,000 half-tone images (image density: 30%) are continuously printed in a high-temperature and high-humidity environment (28° C., 80% RH); and are left to stand overnight in a high-temperature and high-humidity environment (28° C., 80% RH). Then, 100 half-tone images (image density: 30%) are continuously printed, and a 100th-printed image is evaluated by visual inspection.

The evaluation criteria are as follows.

A: The image density is the same as that of the image printed before being left to stand overnight B: The image density of 50% or lower of an image region is reduced as compared to that of the image printed before being left to stand overnight C: The image density of the entire image region is reduced as compared to that of the image printed before being left to stand overnight

Examples D

Examples D1 to D4

Electrophotographic photoreceptors are obtained with the same method as that of Example A1, except that the composition and thickness of the charge transport layer are changed according to Table 5.

Evaluation D

Regarding the electrophotographic photoreceptor obtained in each example, the coating property, the scratch of the inorganic protective layer and the electrical characteristics of the photoreceptor are evaluated with the same method as that of Examples A. In addition, the thin line reproducibility (resolution) is also evaluated.

Evaluation for Resolution

The electrophotographic photoreceptor obtained in each example is mounted onto 700 Digital Color Press (manufactured by Fuji Xerox Co., Ltd.). Using this apparatus, images are printed at 5 line pair/mm in a high-temperature and high-humidity environment (20° C., 40% RH). The printed images are observed with an optical microscope at 50 times for the evaluation.

The evaluation criteria are as follows.

A: The same image (line pair) is printed as compared to the image printed before being left to stand B: The linearity of the image (line pair) deteriorates and partial overlapping occurs, as compared to the image printed before being left to stand C: The image (line pair) is not clear as compared to the image printed before being left to stand

Examples E

Examples E1 to E4

Electrophotographic photoreceptors are obtained with the same method as that of Example A1, except that the composition and thickness of the charge transport layer are changed according to Table 6.

Evaluation E

Regarding the electrophotographic photoreceptor obtained in each example, the coating property, the scratch of the inorganic protective layer and the electrical characteristics of the photoreceptor are evaluated with the same method as that of Examples A.

Examples F

Examples F1 and F2

Electrophotographic photoreceptors are obtained with the same method as that of Example A1, except that the composition and thickness of the charge transport layer are changed according to Table 6.

Evaluation F

Regarding the electrophotographic photoreceptor obtained in each example, the coating property, the scratch of the inorganic protective layer and the electrical characteristics of the photoreceptor are evaluated with the same method as that of Examples A.

Examples G

Examples G1 to G4

Electrophotographic photoreceptors are obtained with the same method as that of Example A1, except that the composition and thickness of the charge transport layer are changed according to Table 7.

Evaluation G

Regarding the electrophotographic photoreceptor obtained in each example, the coating property, the scratch of the inorganic protective layer and the electrical characteristics of the photoreceptor are evaluated with the same method as that of Examples A. In addition, the thin line reproducibility (resolution) is evaluated with the same method as that of Examples D.

Hereinbelow, the details and evaluation results of each example are shown in Tables 2 to 7.

In the tables, abbreviations are as follows.

D50: Volume average particle diameter

TMS: Trimethylsilane

DS: Decylsilane

PS: Phenylsilane

Condensation Ratio of Silica Particles: The condensation ratio of the hydrophobizing agent with respect to the number of silanol groups on the surfaces of the silica particles Concentration of Silica Particles: The content of silica particles with respect to the total weight of the charge transport layer Concentration of Charge Transport Material: The content of the charge transport material with respect to a weight obtained by subtracting the weight of the silica particles from the weight of all the components of the charge transport layer (concentration of charge transport material=weight of charge transport material/(total weight of charge transport layer−weight of silica particles))

Hereinbelow, the characteristics of silica particles of each example measured with the above-described methods are shown in Table 1, and the details and evaluation results of each example are shown in Tables 2 to 7.

TABLE 1

| | Volume Average Particle Diameter (nm) | Kind of Hydrophobizing Agent | Condensation Ratio of Hydrophobizing Agent |
|---|---|---|---|
| Silica Particles (0) | 40 | None | 0 |
| Silica Particles (11) | 40 | Trimethylsilane | 93 |
| Silica Particles (12) | 12 | Trimethylsilane | 91 |
| Silica Particles (13) | 120 | Trimethylsilane | 91 |
| Silica Particles (14) | 40 | Trimethylsilane | 90 |
| Silica Particles (15) | 300 | Trimethylsilane | 91 |
| Silica Particles (21) | 40 | Decylsilane | 92 |
| Silica Particles (31) | 40 | Phenylsilane | 91 |

TABLE 2

| Examples A | | | | | | | | | | | | |
|---|---|---|---|---|---|---|---|---|---|---|---|---|
| | Charge Transport Layer | | | | | | | | | | | |
| | Silica Particles | | | | | Charge Transport Material | | | Protective Layer | Evaluation | | |
| | | | | Hydrophobizing Agent | | | | | | | | |
| | No. | D50 (nm) | Concentration (% by Weight) | Kind | Condensation Ratio (%) | Concentration (% by Weight) | Thickness (μm) | Elastic Modulus GPa | Thickness (μm) | Coating | Scratch | Electrical Properties RP |
| Example A1 | (11) | 40 | 20 | TMS | 93 | 50 | 30 | 5 | 0.25 | A | C | A |
| Example A2 | (11) | 40 | 30 | TMS | 93 | 50 | 30 | 6.5 | 0.25 | A | C | A |
| Example A3 | (11) | 40 | 40 | TMS | 93 | 50 | 32 | 8 | 0.25 | A | B | A |
| Example A4 | (11) | 40 | 50 | TMS | 93 | 50 | 30 | 9.5 | 0.25 | A | A | A |
| Example A5 | (11) | 40 | 60 | TMS | 93 | 50 | 29 | 11 | 0.25 | A | A | A |
| Example A6 | (11) | 40 | 70 | TMS | 93 | 50 | 30 | 12.5 | 0.25 | A | A | — |
| Example A7 | (11) | 40 | 75 | TMS | 93 | 50 | 31 | 14.0 | 0.25 | B | — | — |
| Example A8 | (11) | 40 | 80 | TMS | 93 | 50 | — | — | — | C | — | A |

TABLE 2-continued

| Examples A | | | | | | | | | | | | |
|---|---|---|---|---|---|---|---|---|---|---|---|---|
| | Charge Transport Layer | | | | | | | | | | | |
| | Silica Particles | | | Hydrophobizing Agent | | Charge Transport Material | | | Protective Layer | Evaluation | | |
| | No. | D50 (nm) | Concentration (% by Weight) | Kind | Condensation Ratio (%) | Concentration (% by Weight) | Thickness (μm) | Elastic Modulus GPa | Thickness (μm) | Coating | Scratch | Electrical Properties RP |
| Comparative Example A1 | Not Added | — | 0 | — | — | 42 | 22 | 3 | 0.25 | A | C | |

TABLE 3

| Examples B | | | | | | | | | | | |
|---|---|---|---|---|---|---|---|---|---|---|---|
| | Charge Transport Layer | | | | | | | | | | |
| | Silica Particles | | | Hydrophobizing Agent | | Charge Transport Material | | Protective Layer | Evaluation | | |
| | No. | D50 (nm) | Concentration (% by Weight) | Kind | Condensation Ratio (%) | Concentration (% by Weight) | Thickness (μm) | Thickness (μm) | Coating | Scratch | Electrical Properties RP |
| Example B1 | (11) | 40 | 50 | TMS | 93 | 30 | 30 | 1 | A | A | A |
| Example B2 | (11) | 40 | 50 | TMS | 93 | 40 | 30 | 1 | A | A | A |
| Example B3 | (11) | 40 | 50 | TMS | 93 | 50 | 30 | 1 | A | A | A |
| Example B4 | (11) | 40 | 50 | TMS | 93 | 60 | 31 | 1 | A | A | A |
| Example B5 | (11) | 40 | 50 | TMS | 93 | 70 | 29 | 1 | B | A | A |
| Comparative Example B1 | Not Added | — | 0 | — | — | 42 | 22 | 1 | A | C | A |
| Comparative Example B2 | Not Added | — | 0 | — | — | 60 | 22 | 1 | A | C | A |

TABLE 4

| Example C | | | | | | | | | | | | |
|---|---|---|---|---|---|---|---|---|---|---|---|---|
| | Charge Transport Layer | | | | | | | | | | | |
| | Silica Particles | | | Hydrophobizing Agent | | Charge Transport Material | | Surface Roughness Ra of Charge | Protective Layer | Evaluation | | |
| | No. | D50 (nm) | Concentration (% by Weight) | Kind | Condensation Ratio (%) | Concentration (% by Weight) | Thickness (μm) | Transport Layer (μm) | Thickness (μm) | Scratch | Electrical Properties RP | Cleaning Property |
| Example C1 | (11) | 40 | 50 | TMS | 93 | 50 | 30 | 0.08 | 0.25 | A | A | C |
| Example C2 | (11) | 40 | 50 | TMS | 93 | 50 | 30 | 0.06 | 0.25 | A | A | B |
| Example C3 | (11) | 40 | 50 | TMS | 93 | 50 | 30 | 0.03 | 0.25 | A | A | A |
| Comparative Example C1 | Not Added | — | — | — | — | 42 | 22 | 0.01 | 0.25 | C | A | A |

TABLE 5

| Examples D | | | | | | | | | | | | |
|---|---|---|---|---|---|---|---|---|---|---|---|---|
| | Charge Transport Layer | | | | | | | | | | | |
| | Silica Particles | | | Hydrophobizing Agent | | Charge Transport Material | | Protective Layer | Evaluation | | | |
| | No. | D50 (nm) | Concentration (% by Weight) | Kind | Condensation Ratio (%) | Concentration (% by Weight) | Thickness (μm) | Thickness (μm) | Coat-ing | Resolu-tion | Scratch | Electrical Properties RP |
| Example D1 | (12) | 12 | 50 | TMS | 91 | 50 | 31 | 0.25 | B | — | — | — |
| Example D2 | (11) | 40 | 50 | TMS | 93 | 50 | 30 | 0.25 | A | A | A | A |
| Example D3 | (13) | 120 | 50 | TMS | 91 | 50 | 32 | 0.25 | A | A | A | A |
| Example D4 | (15) | 300 | 50 | — | 91 | 50 | 30 | 0.25 | A | C | A | A |

TABLE 6

| Examples E and F | | | | | | | | | | | | |
|---|---|---|---|---|---|---|---|---|---|---|---|---|
| | Charge Transport Layer | | | | | | | | | | | |
| | Silica Particles | | | Hydrophobizing Agent | | Charge Transport Material | | Protective Layer | Evaluation | | | |
| | No. | D50 (nm) | Concentration (% by Weight) | Kind | Condensation Ratio (%) | Concentration (% by Weight) | Thickness (μm) | Thickness (μm) | Coating | Scratch | Electrical Properties RP | |
| Example E1 | (0) | 40 | 50 | Untreated | 0 | 50 | 30 | 0.25 | C | — | — | |
| Example E2 | (11) | 40 | 50 | TMS | 93 | 50 | 30 | 0.25 | A | A | A | |
| Example E3 | (21) | 40 | 50 | DS | 92 | 50 | 28 | 0.25 | A | A | A | |
| Example E4 | (31) | 40 | 50 | PS | 91 | 50 | 29 | 0.25 | A | A | A | |
| Example F1 | (11) | 40 | 50 | TMS | 93 | 50 | 30 | 0.25 | A | A | A | |
| Example F2 | (14) | 40 | 50 | TMS | 90 | 50 | 30 | 0.25 | A | A | C | |

TABLE 7

| Examples G | | | | | | | | | | | | |
|---|---|---|---|---|---|---|---|---|---|---|---|---|
| | Charge Transport Layer | | | | | | | | | | | |
| | Silica Particles | | | Hydrophobizing Agent | | Charge Transport Material | | Protective Layer | Evaluation | | | |
| | No. | D50 (nm) | Concentration (% by Weight) | Kind | Condensation Ratio (%) | Concentration (% by Weight) | Thickness (μm) | Thickness (μm) | Coat-ing | Resolu-tion | Scratch | Electrical Properties RP |
| Example G1 | (11) | 40 | 50 | TMS | 93 | 50 | 10 | 0.25 | A | A | A | A |
| Example G2 | (11) | 40 | 50 | TMS | 93 | 50 | 30 | 0.25 | A | A | A | A |
| Example G3 | (11) | 40 | 50 | TMS | 93 | 50 | 40 | 0.25 | A | A | A | A |
| Example G4 | (11) | 40 | 50 | TMS | 93 | 50 | 50 | 0.25 | A | C | A | B |

It can be seen from the above results that, in the Examples, as compared to the Comparative Examples, the scratch of the inorganic protective layer and the electrical characteristics are superior.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

an organic photosensitive layer that is provided on the conductive substrate; and an inorganic protective layer that is provided on the organic photosensitive layer so as to be in contact with a surface of the organic photosensitive layer, wherein the organic photosensitive layer includes at least a charge generation layer and a charge transport layer, the charge transport layer including at least a charge transport material and silica particles in a region on the surface side in contact with the inorganic protective layer and arranged on the conductive substrate in this order, wherein a weight content of the silica particles in the charge transport layer is greater than a weight content of the charge transport material, wherein a content of the silica particles is from 30% by weight to 70% by weight with respect to the total weight of the charge transport layer, the weight of the charge transport material obtained by subtracting the weight of the silica particles from the weight of all the components of the charge transport layer, and wherein a surface side of the charge transport layer is in direct contact with the inorganic protective layer, and a side of the charge transport material opposite the surface side is in direct contact with the charge generation layer.

2. The electrophotographic photoreceptor according to claim 1, wherein a content of the charge transport material is from 40% by weight to 60% by weight with respect to a weight obtained by subtracting the weight of the silica particles from the weight of all the components of the charge transport layer.

3. The electrophotographic photoreceptor according to claim 1, wherein a surface roughness Ra of a surface of the charge transport layer on the side of the inorganic protective layer is less than or equal to 0.06 μm.

4. The electrophotographic photoreceptor according to claim 1, wherein an elastic modulus of the charge transport layer is greater than or equal to 5 GPa.

5. The electrophotographic photoreceptor according to claim 1, wherein a volume average particle diameter of the silica particles is from 20 nm to 200 nm.

6. The electrophotographic photoreceptor according to claim 1, wherein surfaces of the silica particles are treated with a hydrophobizing agent.

7. The electrophotographic photoreceptor according to claim 6, wherein the hydrophobizing agent is a silane compound having a trimethylsilyl group, a decylsilyl group, or a phenylsilyl group.

8. The electrophotographic photoreceptor according to claim 6, wherein a condensation ratio of the silica particles, of which the surfaces are treated with the hydrophobizing agent, is higher than or equal to 90%.

9. The electrophotographic photoreceptor according to claim 1, wherein a thickness of the charge transport layer is from 10 μm to 40 μm.

10. The electrophotographic photoreceptor according to claim 1, wherein a volume resistivity of the silica particles is greater than or equal to $10^{11}$ Ω·cm.

11. A process cartridge, which is detachable from an image forming apparatus, comprising the electrophotographic photoreceptor according to claim 1.

12. An image forming apparatus comprising:

the electrophotographic photoreceptor according to claim 1;

a charging unit that charges a surface of the electrophotographic photoreceptor;

a latent image forming unit that forms a latent image on a charged surface of the electrophotographic photoreceptor;

a developing unit that develops the latent image, formed on the surface of the electrophotographic photoreceptor, using a toner to form a toner image; and a transfer unit that transfers the toner image, formed on the surface of the electrophotographic photoreceptor, onto a recording medium.

* * * * *